US011560897B2

(12) United States Patent
Fujita et al.

(10) Patent No.: US 11,560,897 B2
(45) Date of Patent: Jan. 24, 2023

(54) BLOWER AND AIR-CONDITIONING INDOOR UNIT

(71) Applicant: DAIKIN INDUSTRIES, LTD., Osaka (JP)

(72) Inventors: Hiroki Fujita, Osaka (JP); Masafumi Uda, Osaka (JP); Sachiko Matsumoto, Saka (JP); Hayato Nuno, Osaka (JP); Kei Takenaka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/696,415

(22) Filed: Mar. 16, 2022

(65) Prior Publication Data

US 2022/0205448 A1 Jun. 30, 2022

Related U.S. Application Data

(63) Continuation of application No. PCT/JP2020/035084, filed on Sep. 16, 2020.

(30) Foreign Application Priority Data

Sep. 17, 2019 (JP) ..... JP2019-168835
Oct. 31, 2019 (JP) ..... JP2019-198205

(51) Int. Cl.
*F04D 17/04* (2006.01)
*F24F 11/74* (2018.01)
(Continued)

(52) U.S. Cl.
CPC ..... *F04D 17/04* (2013.01); *F24F 11/74* (2018.01); *F24F 13/06* (2013.01); *F24F 13/10* (2013.01); *F24F 13/20* (2013.01); *F24F 13/26* (2013.01)

(58) Field of Classification Search
CPC . F04D 17/04; F24F 11/74; F24F 13/06; F24F 13/10; F24F 13/20; F24F 13/26
See application file for complete search history.

(56) References Cited

U.S. PATENT DOCUMENTS

2005/0257561 A1* 11/2005 Lee ..... F24F 1/0018 62/428
2013/0153173 A1* 6/2013 Nakamura ..... F24F 11/77 165/96
2015/0377242 A1* 12/2015 Furuhashi ..... F24F 11/79 415/148

FOREIGN PATENT DOCUMENTS

JP 10-19300 A 1/1998
JP 6156623 B2 * 7/2017
(Continued)

OTHER PUBLICATIONS

English translation of International Preliminary Report on Patentability and Written Opinion of the International Searching Authority for International Application No. PCT/JP2020/035084, dated Mar. 31, 2022.

(Continued)

*Primary Examiner* — Emmanuel E Duke
(74) *Attorney, Agent, or Firm* — Birch, Stewart, Kolasch & Birch, LLP

(57) ABSTRACT

A suction port and a blow-out port are formed in a casing. A fan is provided in the casing. Under a test condition that a blower is provided in such a way that a reference position of the blow-out port is a position that is separated by 2000 mm upward from a floor, an airflow adjusting mechanism adjusts, in a wide mode, a flow of air blown out from the blow-out port so that an average airflow speed in a first range and an average airflow speed in a second range are approximately equal to each other and so that a ratio of an average (Continued)

airflow speed in a third range to the average airflow speed in the first range is less than 1.5.

24 Claims, 12 Drawing Sheets

(51) Int. Cl.

| | |
|---|---|
| ***F24F 13/06*** | (2006.01) |
| ***F24F 13/10*** | (2006.01) |
| ***F24F 13/20*** | (2006.01) |
| *F24F 13/26* | (2006.01) |

(56) References Cited

FOREIGN PATENT DOCUMENTS

| | | | | | |
|---|---|---|---|---|---|
| JP | 2017-138040 | A | | 8/2017 | |
| JP | 2018025343 | A | * | 2/2018 | |
| JP | 2018025343 | A | * | 2/2018 | ..... F24F 1/00 |
| JP | 2018-185055 | A | | 11/2018 | |
| WO | WO 2016/207946 | A1 | | 12/2016 | |

OTHER PUBLICATIONS

International Search Report (PCT/ISA/210) issued in PCT/JP2020/035084 dated Nov. 24, 2020.
Written Opinion (PCT/ISA/237) issued in PCT/JP2020/035084 dated Nov. 24, 2020.

* cited by examiner

WIDE AIRFLOW

NORMAL AIRFLOW

BLOWER AND AIR-CONDITIONING INDOOR UNIT

CROSS REFERENCE TO RELATED APPLICATIONS

This application is a Continuation of PCT International Application No. PCT/JP2020/035084, filed on Sep. 16, 2020, which claims priority under 35 U.S.C. 119(a) to Patent Application Nos. 2019-168835, filed in Japan on Sep. 17, 2019, and 2019-198205, filed in Japan on Oct. 31, 2019, all of which are hereby expressly incorporated by reference into the present application.

TECHNICAL FIELD

The present disclosure relates to a blower and an air-conditioning indoor unit.

BACKGROUND ART

An air conditioner is disclosed in PTL 1. The air conditioner includes: a body case having a blow-out port, for blowing-out air, in a bottom part thereof a first blade that is disposed near the front of a bottom portion of the body case and whose position in the up-down direction and inclination are independently adjustable; and a second blade that is disposed near the back of the bottom portion of the body case and that rotates in correspondence with the position of the first blade.

CITATION LIST

Patent Literature

PTL 1: International Publication No. 2016/207946

SUMMARY

A first aspect of the present disclosure relates to a blower provided on a side wall and having a wide mode. The blower includes: a casing (11) in which a suction port (14) and a blow-out port (15) are formed; a fan (12) provided in the casing (11); and an airflow adjusting mechanism (20) configured to adjust a blow-out airflow that is a flow of air blown out from the blow-out port (15). The blow-out port (15) extends in a left-right direction of the blower. A length (L15) of the blow-out port (15) in a width direction perpendicular to an extension direction of the blow-out port (15) is less than or equal to 300 mm. A reference point (P0) is defined as at least one point that is positioned in a range, in a front-back direction, starting at a first point (P1) that is separated by 1000 mm ahead of the blower from the blow-out port (15) and ending at a second point (P2) that is separated by 2000 mm ahead of the blower from the blow-out port (15). A reference height range (R10) is defined as a range, in an up-down direction, starting at the reference point (P0) and ending at a position that is separated by 1600 mm upward from the reference point (P0). Among three ranges obtained by trisecting the reference height range (R10) in the up-down direction, a first range (R11) is defined as a range positioned on an upper side, a second range (R12) is defined as a range positioned on a lower side, and a third range (R13) is defined as a range positioned at a center. Under a test condition that the blower is provided in such a way that a reference position (Q) of the blow-out port (15) is a position that is separated by 2000 mm upward from a floor, the airflow adjusting mechanism (20) adjusts, in the wide mode, the blow-out airflow so that an average airflow speed in the first range (R11) and an average airflow speed in the second range (R12) are approximately equal to each other and so that a ratio of an average airflow speed in the third range (R13) to the average airflow speed in the first range (R11) is less than 1.5.

DESCRIPTION OF EMBODIMENTS

Figure 1:
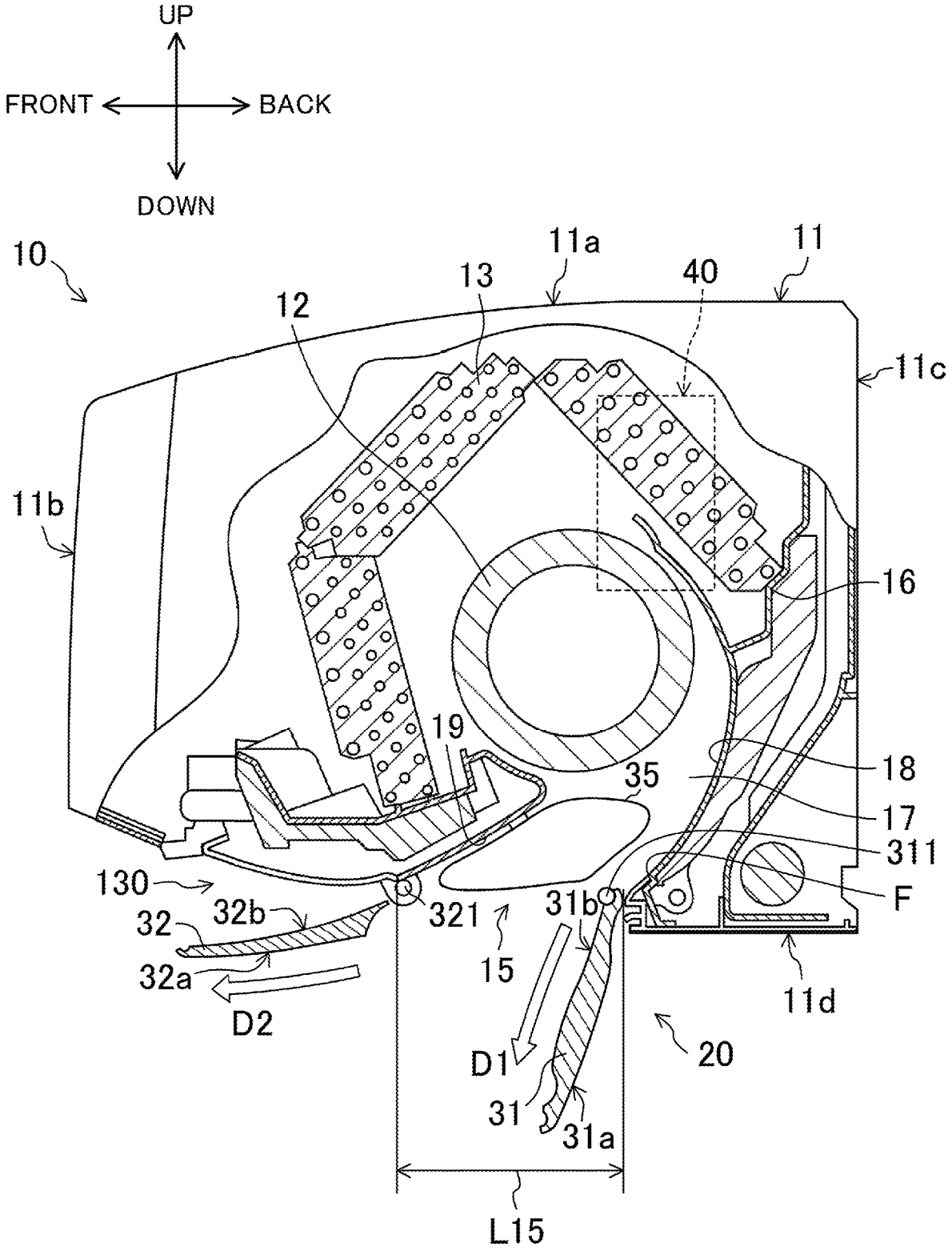
FIG. 1 is a sectional view illustrating an example of the configuration of an air-conditioning indoor unit according to a first embodiment.

Hereafter, embodiments will be described in detail with reference to the drawings. The same parts or corresponding parts in the drawings are denoted by the same numerals, and descriptions thereof will not be repeated.

First Embodiment

Figure 2:
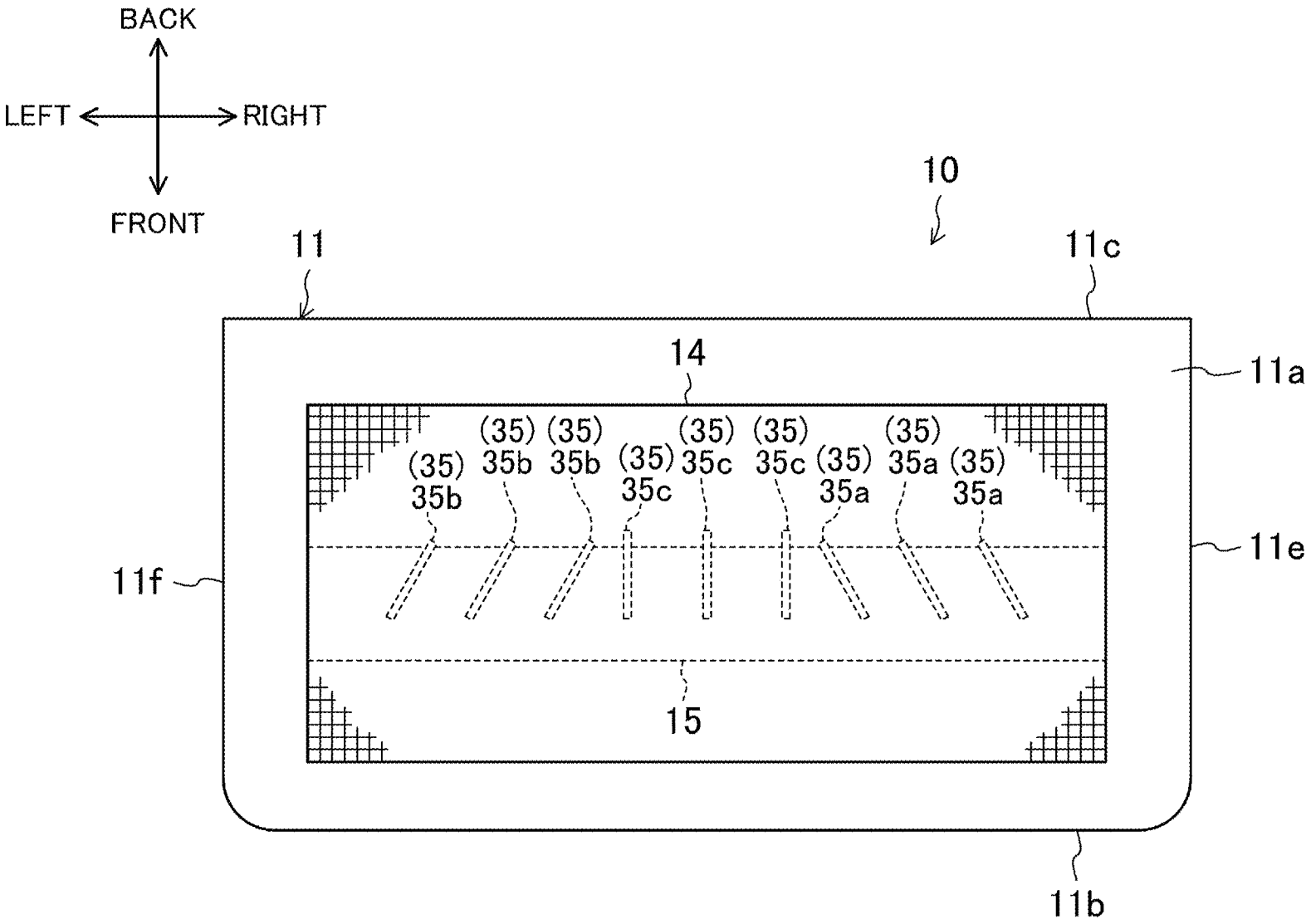
FIG. 2 is a plan view illustrating an example of the configuration of the air-conditioning indoor unit according to the first embodiment.

FIGS. 1 and 2 illustrate an example of the configuration of an air-conditioning indoor unit (10) according to a first embodiment. The air-conditioning indoor unit (10) is an example of a blower. In this example, the air-conditioning indoor unit (10) is provided on a side wall of an indoor space. For example, the air-conditioning indoor unit (10) performs a cooling operation, a heating operation, a dehumidifying operation, a humidifying operation, a blowing operation, and the like. In this example, the air-conditioning indoor unit (10) has a wide mode and a normal mode, as a blow-out mode. The blow-out mode of the air-conditioning indoor unit (10) is switchable between the wide mode and the normal mode. The blow-out mode will be described below in detail.

The air-conditioning indoor unit (10) includes a casing (11), a fan (12), a heat exchanger (13), a bottom frame (16), an airflow adjusting mechanism (20), and a controller (40). In the following description, "front", "back", "left", "right", "up", and "down" represent directions in a front view of the air-conditioning indoor unit (10) provided on a side wall.

[Casing]

In the casing (11), the fan (12), the heat exchanger (13), the bottom frame (16), the airflow adjusting mechanism (20), and the controller (40) are accommodated. In this example, the casing (11) has a rectangular-box-like shape extending in the left-right direction. To be specific, the casing (11) includes a top panel (11*a*), a front panel (11*b*), a back panel (11*c*), a bottom panel (11*d*), a right panel (11*e*), and a left panel (110. An upper end of the front panel (11*b*) is rotatably supported by the top panel (11*a*).

A suction port (14) and a blow-out port (15) are formed in the casing (11). In this example, the suction port (14) is provided in the top panel (11*a*) and has a rectangular shape. The blow-out port (15) is provided in a lower part of the casing (11). The blow-out port (15) extends in the left-right direction of the air-conditioning indoor unit (10). To be specific, the blow-out port (15) is provided in the bottom panel (11*d*) and has a rectangular shape extending in the left-right direction. The extension direction (longitudinal direction) of the blow-out port (15) is the left-right direction; and the width direction (transversal direction) of the blow-out port (15), which is perpendicular to the extension direction of the blow-out port (15), is the front-back direction. In other words, the blow-out port (15) is a horizontally-elongated opening. The blow-out port (15) opens in the left-right direction of the air-conditioning indoor unit (10). The width direction of the blow-out port (15) is perpendicular to the opening direction of the blow-out port (15).

In this example, the length (L15) of the blow-out port (15) in the width direction is less than or equal to 300 mm. The length (L15) of the blow-out port (15) in the width direction may be less than or equal to 150 mm.

[Fan]

The fan (12) is attached to the bottom frame (16). The fan (12) blows out air, which has been sucked from the suction port (14), from the blow-out port (15). In this example, the fan (12) is a cross-flow fan.

[Heat Exchanger]

The heat exchanger (13) is attached to the bottom frame (16). The heat exchanger (13) causes air, which is sucked from the suction port (14), and a refrigerant to exchange heat. As the heat exchanger (13) performs heat exchange between the air and the refrigerant, the temperature of the air can be adjusted. Air that has passed through the heat exchanger (13) is blown out from the blow-out port (15). In this example, the heat exchanger (13) has an inverted V-shape both ends of which are bent downward as seen from the left-right direction. The fan (12) is disposed below the heat exchanger (13).

[Blow-Out Flow Path and Scroll]

A blow-out flow path (17) is formed in the casing (11). The bottom frame (16) includes a back-side scroll (18) and a front-side scroll (19). The back-side scroll (18) is a partition wall that is a part of the bottom frame (16).

The blow-out flow path (17) connects the inside of the casing (11) and the blow-out port (15). The back-side scroll (18) is curved to face the fan (12). The blow-out flow path (17) extends from the blow-out port (15) along the back-side scroll (18). A terminal end (F) of the back-side scroll (18) is positioned at a back edge of the blow-out port (15). The front-side scroll (19) faces the back-side scroll (18) with the blow-out flow path (17) therebetween.

[Flow of Air]

When the fan (12) is driven, air (in this example, indoor air) sucked from the suction port (14) of the top panel (11*a*) passes through the heat exchanger (13), is sucked into the fan (12), passes through the fan (12) and the blow-out flow path (17), and is blown out from the blow-out port (15). The air passing through the blow-out flow path (17) progresses along the back-side scroll (18), and is blown in the tangential direction of the terminal end (F) of the back-side scroll (18).

[Airflow Adjusting Mechanism]

The airflow adjusting mechanism (20) is provided at the blow-out port (15). The airflow adjusting mechanism (20) adjusts the flow of air blown out from the blow-out port (15) (hereafter, referred to as "blow-out airflow"). In this example, the airflow adjusting mechanism (20) includes a first airflow-direction adjusting blade (31), a second airflow-direction adjusting blade (32), and three or more (to be specific, nine) auxiliary adjusting blades (35).

<First Airflow-Direction Adjusting Blade>

The first airflow-direction adjusting blade (31) has a plate-like shape extending in the extension direction of the blow-out port (15), and is provided near the back of the blow-out port (15). The first airflow-direction adjusting blade (31) is switchable among a plurality of positions at inclination angles that differ from each other (angles around a swing axis extending in the extension direction of the blow-out port (15)). By switching the position of the first airflow-direction adjusting blade (31), it is possible to adjust the orientation of the blow-out airflow in the up-down direction (in particular, the spread in the downward direction).

To be specific, a first swing axis (311) is fixed to a base portion (one edge portion in the width direction) of the first airflow-direction adjusting blade (31). The first swing axis (311) is swingably supported by the casing (11). A first motor (not shown) is coupled to the first swing axis (311). When the first motor is driven, the first airflow-direction adjusting blade (31) swings around the first swing axis (311), and the position of the first airflow-direction adjusting blade (31) is switched.

In this example, the first airflow-direction adjusting blade (31) extends in the extension direction of the blow-out port (15) without being divided in the extension direction of the blow-out port (15). The first airflow-direction adjusting blade (31) is formed to be continuous with a back edge portion of the blow-out port (15).

Figure 6:
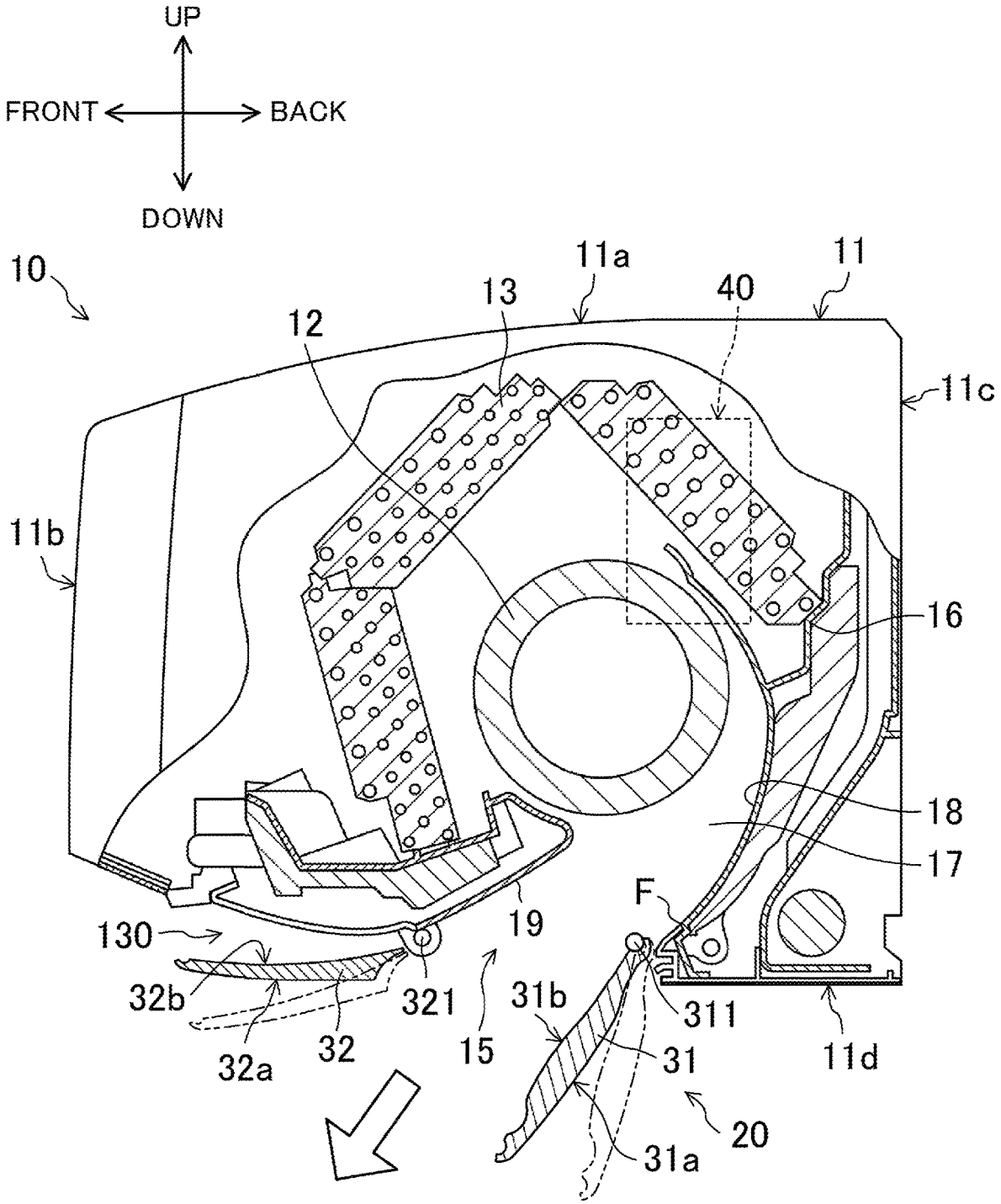
FIG. 6 is a sectional view illustrating the positions of airflow-direction adjusting blades in a normal mode.

In this example, the first airflow-direction adjusting blade (31) is switchable at least among a position in which the first airflow-direction adjusting blade (31) closes the blow-out port (15), a position illustrated in FIG. 1 (position corresponding to the wide mode), and a position illustrated in FIG. 6 (position corresponding to the normal mode). When the position of the first airflow-direction adjusting blade (31) is a position in which the first airflow-direction adjusting blade (31) closes the blow-out port (15), an outer surface (31*a*) of the first airflow-direction adjusting blade (31) is on the extension of an outer surface of the bottom panel (11*d*) of the casing (11). When the position of the first airflow-direction adjusting blade (31) is the position illustrated in FIG. 1 (or FIG. 6), air blown out from the blow-out port (15) flows generally along an inner surface (31*b*) of the first airflow-direction adjusting blade (31).

<Second Airflow-Direction Adjusting Blade>

The second airflow-direction adjusting blade (32) has a plate-like shape extending in the extension direction of the blow-out port (15), and is provided near the front of the blow-out port (15). The second airflow-direction adjusting blade (32) is switchable among a plurality of positions at inclination angles that differ from each other (angles around a swing axis extending in the extension direction of the blow-out port (15)). By switching the position of the second airflow-direction adjusting blade (32), it is possible to adjust the orientation of the blow-out airflow in the up-down direction (in particular, the spread in the upward direction).

To be specific, a second swing axis (321) is fixed to a base portion (one edge portion in the width direction) of the second airflow-direction adjusting blade (32). The second swing axis (321) is swingably supported by the casing (11). A second motor (not shown) is coupled to the second swing axis (321). When the second motor is driven, the second airflow-direction adjusting blade (32) swings around the second swing axis (321), and the position of the second airflow-direction adjusting blade (32) is switched.

In this example, the second airflow-direction adjusting blade (32) extends in the extension direction of the blow-out port (15) without being divided in the extension direction of the blow-out port (15). The second airflow-direction adjusting blade (32) is configured to be continuous with a front edge portion of the blow-out port (15).

In this example, the second airflow-direction adjusting blade (32) is switchable at least among a position in which is the second airflow-direction adjusting blade (32) is accommodated in an accommodation portion (130), a position illustrated in FIG. 1 (position corresponding to the wide mode), and a position illustrated in FIG. 6 (position corresponding to the normal mode). When the position of the second airflow-direction adjusting blade (32) is the position in which the second airflow-direction adjusting blade (32) is accommodated in the accommodation portion (130), an outer surface (32*a*) of the second airflow-direction adjusting blade (32) is on the extension of an outer surface of the bottom panel (11*d*) of the casing (11). An inner surface (32*b*) of the second airflow-direction adjusting blade (32) is formed to extend along an outer surface of the accommodation portion (130).

<Configurations of First Airflow-Direction Adjusting Blade and Second Airflow-Direction Adjusting Blade>

In this example, the first airflow-direction adjusting blade (31) is configured to spread the blow-out airflow downward in the wide mode. The second airflow-direction adjusting blade (32) is configured to spread the blow-out airflow upward in the wide mode. The first airflow-direction adjusting blade (31) and the second airflow-direction adjusting blade (32) are configured to divide the blow-out airflow in the up-down direction in the wide mode due to the Coanda effect. Division of the blow-out airflow in the wide mode will be described below in detail.

<Auxiliary Adjusting Blade>

The plurality of the auxiliary adjusting blades (35) are provided at the blow-out port (15) to be arranged in the left-right direction of the air-conditioning indoor unit (10). Each of the plurality of auxiliary adjusting blades (35) is configured to divide the blow-out airflow in the left-right direction.

To be specific, the plurality of auxiliary adjusting blades (35) have configurations that are similar to each other. Each auxiliary adjusting blade (35) has a plate-like shape extending in the up-down direction. Each auxiliary adjusting blade (35) is swingable in the left-right direction around a position such that a plate surface thereof is perpendicular to the extension direction of the blow-out port (15). By swinging the auxiliary adjusting blades (35) in the left-right direction, it is possible to adjust the orientation of the blow-out airflow in the left-right direction. The auxiliary adjusting blades (35) are so-called vertical airflow-direction adjusting blades.

In this example, the nine auxiliary adjusting blades (35) include three first auxiliary adjusting blades (35*a*) that are disposed near the right of the blow-out port (15), three second auxiliary adjusting blades (35*b*) that are disposed near the left of the blow-out port (15), and three third auxiliary adjusting blades (35*c*) that are disposed at a middle part of the blow-out port (15). The three first auxiliary adjusting blades (35*a*) are coupled to a coupling rod (not shown) extending in the left-right direction of the blow-out port (15), and an auxiliary motor (not shown) is coupled to the coupling rod. When the auxiliary motor is driven, the coupling rod moves in the left-right direction, and the three first auxiliary adjusting blades (35*a*) swing in the left-right direction. The configurations of the three second auxiliary adjusting blades (35*b*) and the configurations of and three third auxiliary adjusting blades (35*c*) are similar to the configurations of the three first auxiliary adjusting blades (35*a*).

[Controller]

The controller (40) controls each portion of the air-conditioning indoor unit (10) based on signals from various sensors (not shown) provided in the air-conditioning indoor unit (10) and instructions from the outside (for example, a remote controller). Thus, the action of the air-conditioning indoor unit (10) is controlled. In this example, the controller (40) performs operation control, airflow-direction control, airflow-rate control, temperature control, humidity control, and the like. In the operation control, the controller (40) determines the operation mode of the air-conditioning indoor unit (10). In the airflow-direction control, the controller (40) controls the airflow adjusting mechanism (20). To be specific, in the airflow-direction control, the controller (40) controls the positions of the first airflow-direction adjusting blade (31), the second airflow-direction adjusting blade (32), and the auxiliary adjusting blades (35). In the airflow-direction control, the controller (40) controls the airflow adjusting mechanism (20) to switch between the blow-out modes. In the airflow-rate control, the controller (40) controls the flow rate of air blown out by the fan (12). To be specific, in the airflow-rate control, the controller (40) controls the rotation speed of the fan (12). For example, the controller (40) is constituted by a processor and a memory that stores a program for operating the processor and information.

[Features Related to Blow-Out Airflow in Wide Mode]

Figure 3:
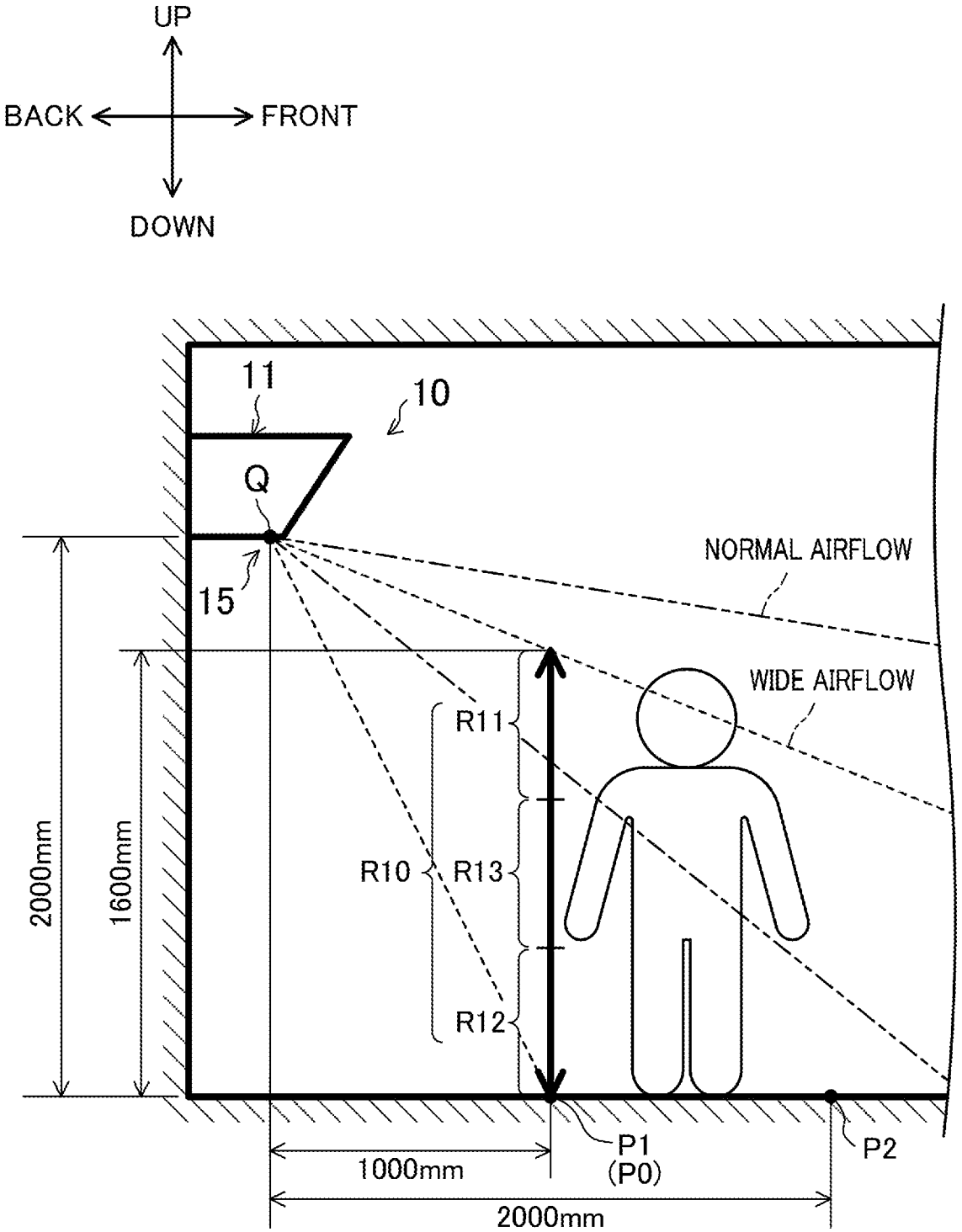
FIG. 3 is a schematic view illustrating an example of a blow-out airflow in a wide mode.
Figure 4:
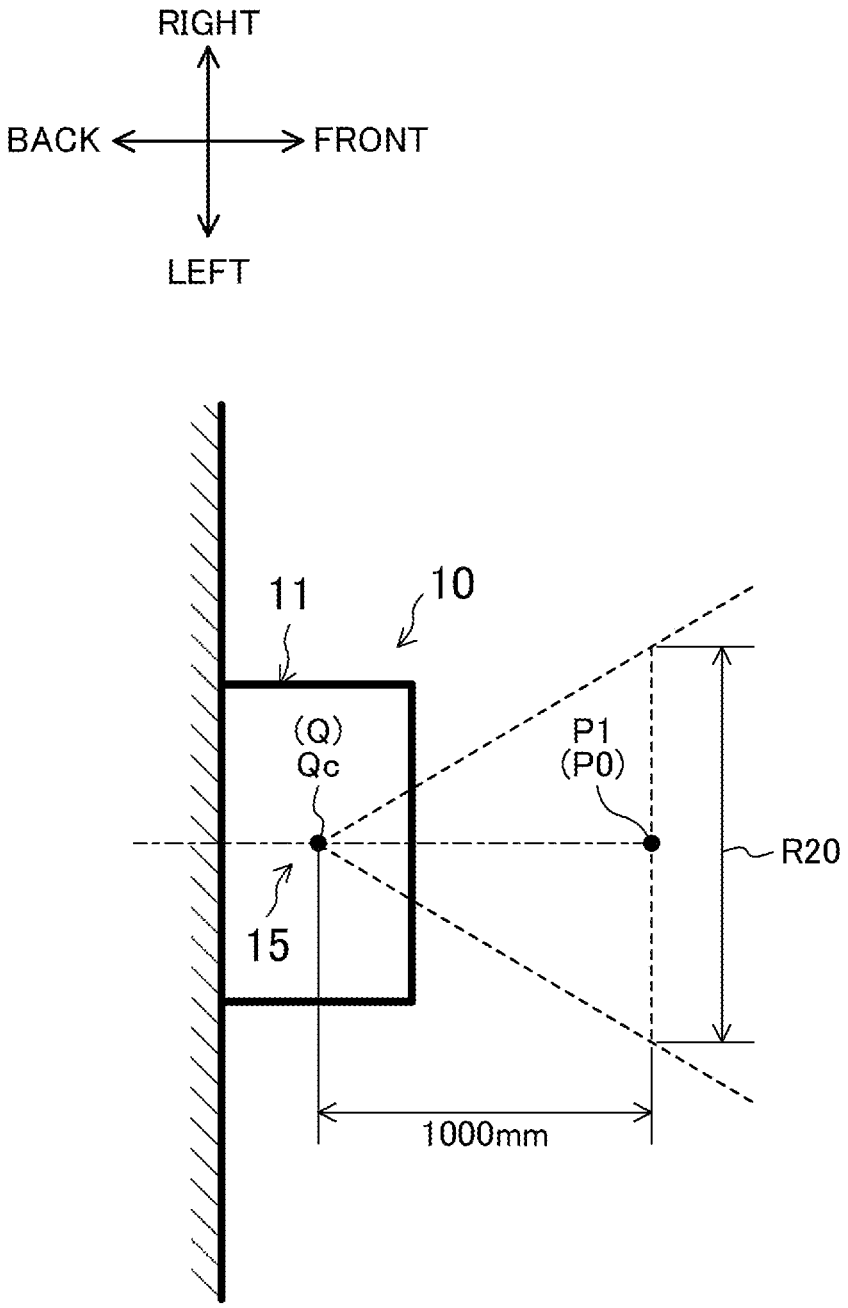
FIG. 4 is a schematic view illustrating an example of a blow-out airflow in the wide mode.

Next, referring to FIGS. 3, 4, and 5, features related to a blow-out airflow in the wide mode will be described. The wide mode is a blow-out mode for generating a blow-out airflow (hereafter, referred to as "wide airflow") whose variation in airflow speed in the up-down direction is reduced and that can be blown toward the whole body of a user.

In the following description, a "reference point (P0)" is defined as at least one point that is positioned in a range, in the front-back direction, starting at a first point (P1) that is separated by 1000 mm ahead of the air-conditioning indoor unit (10) from the blow-out port (15) (to be specific, a point on a floor directly below a reference position (Q) of the blow-out port (15)) and ending at a second point (P2) that is separated by 2000 mm ahead of the air-conditioning indoor unit (10) from the blow-out port (15) (to be specific, the point on the floor directly below the reference position (Q) of the blow-out port (15)). In the example illustrated in FIGS. 3 and 4, the reference point (P0) coincides with the first point (P1). The first point (P1), the second point (P2), and the reference point (P0) are points on the floor.

A "reference height range (R10)" is defined as a range in the up-down direction starting at the reference point (P0) and ending at a position that is separated by 1600 mm upward from the reference point (P0). Among three ranges obtained by trisecting the reference height range (R10) in the up-down direction, a "first range (R11)" is defined as a range positioned on the upper side, a "second range (R12)" is defined as a range positioned on the lower side, and a "third range (R13)" is defined as a range positioned at the center. The length "1600 mm" of the reference height range (R10) is a value that is determined based on, for example, the stature of a standard user (a specific example is an adult male).

<Test Condition>

In the present disclosure, a test condition is set in order to facilitate verification of features related to blow-out airflow in the wide mode. The test condition is a condition that the air-conditioning indoor unit (10) is provided in such a way that the reference position (Q) of the blow-out port (15) is a position that is separated by 2000 mm upward from a floor. In the example illustrated in FIGS. 3 and 4, the reference position (Q) of the blow-out port (15) is the center position of the blow-out port (15) (the center position in the extension direction and in the width direction, or, in other words, the intersection of the diagonal lines).

<Action of Airflow Adjusting Mechanism>

In the wide mode under the test condition, the airflow adjusting mechanism (20) adjusts the blow-out airflow so that the average airflow speed in the first range (R11) and the average airflow speed in the second range (R12) are approximately equal to each other and so that the ratio of the average airflow speed in the third range (R13) to the average airflow speed in the first range (R11) is less than 1.5.

A state such that "the average airflow speed in the first range (R11) and the average airflow speed in the second range (R12) are approximately equal to each other" includes, not only a state in which the average airflow speed in the first range (R11) and the average airflow speed in the second range (R12) are completely equal to each other but also a state in which the difference between the average airflow speed in the first range (R11) and the average airflow speed in the second range (R12) is less than or equal to a predetermined allowance value. The allowance value may be set to, for example, 10% of the greater one of the average airflow speed in the first range (R11) and the average airflow speed in the second range (R12).

The average airflow speed in each of the first range (R11), the second range (R12), and the third range (R13) may be measured as follows. For example, a plurality of anemometers are arranged in the reference height range (R10) in the up-down direction. To be specific, the plurality of anemometers are arranged in the reference height range (R10) on a straight line extending in the up-down direction. The average of airflow speeds measured by a plurality of the anemometers disposed in the first range (R11) may be defined as "the average airflow speed in the first range (R11)". The average of airflow speeds measured by a plurality of the anemometers disposed in the second range (R12) may be defined as "the average airflow speed in the second range (R12)". The average of airflow speeds measured by a plurality of the anemometers disposed in the third range (R13) may be defined as "the average airflow speed in the third range (R13)". Alternatively, the average airflow speed in each of the first range (R11), the second range (R12), and the third range (R13) may be estimated by simulation.

In this example, in the wide mode under the test condition, the airflow adjusting mechanism (20) adjusts the blow-out airflow so that a wide airflow-speed distribution condition is satisfied in a range (R20) in the left-right direction. The wide airflow-speed distribution condition is an airflow-speed distribution condition that the average airflow speed in the first range (R11) and the average airflow speed in the second range (R12) are approximately equal to each other and that the ratio of the average airflow speed in the third range (R13) to the average airflow speed in the first range (R11) is less than 1.5. The range (R20) in the left-right direction is a range in the left-right direction that is centered at a center position (Qc) of the blow-out port (15) in the left-right direction and that has a length in the left-right direction greater than or equal to 1000 mm. The lower limit value "1000 mm" of the length of the range (R20) in the left-right direction is a value that is determined based on, for example, the width of a standard user (as a specific example, an adult male).

In the wide mode under the test condition, the airflow adjusting mechanism (20) adjusts the blow-out airflow so that the average airflow speed in the reference height range (R10) is greater than or equal to 0.5 m/s.

<Details of Blow-Out Airflow in Wide Mode>

In this example, in the wide mode, the positions of the first airflow-direction adjusting blade (31) and the second airflow-direction adjusting blade (32) are, for example, the positions illustrated in FIG. 1. As illustrated in FIG. 1, in the wide mode, the blow-out airflow is guided downward along the first airflow-direction adjusting blade (31) due to the Coanda effect of the first airflow-direction adjusting blade (31). The blow-out airflow is guided upward along the second airflow-direction adjusting blade (32) due to the Coanda effect of the second airflow-direction adjusting blade (32). The blow-out airflow is divided in the up-down direction due to these Coanda effects. To be specific, the blow-out airflow is divided into a first airflow (D1) along the first airflow-direction adjusting blade (31) and a second airflow (D2) along the second airflow-direction adjusting blade (32). Each of the first airflow (D1) and the second airflow (D2) gradually spreads in the up-down direction as air flows further toward the downstream side, and parts of these airflows join each other. In this way, the blow-out airflow is spread in the up-down direction.

As described above, in the wide mode, the airflow adjusting mechanism (20) divides the blow-out airflow in the up-down direction to generate a plurality of airflows. The plurality of airflows gradually spread as air flows further toward the downstream side, and parts of two of these airflows that are adjacent to each other in the up-down direction join each other. In this way, the blow-out airflow is spread in the up-down direction.

<Airflow Speed Distribution of Blow-Out Airflow in Wide Mode>

Figure 5:
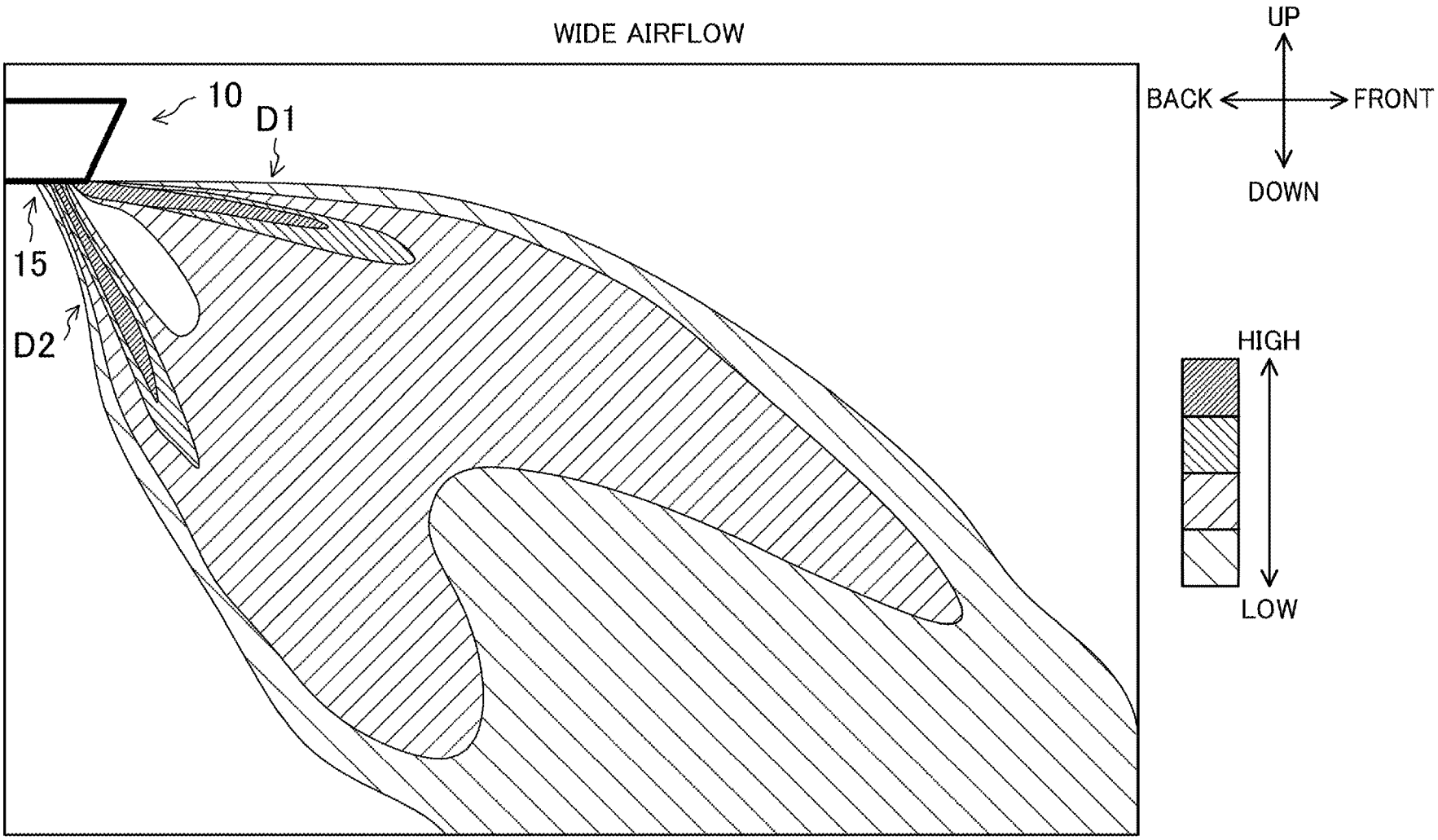
FIG. 5 is an airflow-speed distribution view illustrating an example of the airflow speed distribution of a blow-out airflow in the wide mode.

FIG. 5 illustrates an example of the airflow speed distribution of the blow-out airflow in the wide mode. In the example illustrated in FIG. 5, the airflow-speed region of the blow-out airflow is classified into four airflow-speed regions. The four airflow-speed regions respectively correspond to four airflow-speed ranges. A first airflow-speed region is a region hatched with fine lines diagonally upward to the right, and is a region representing the airflow-speed peak of the blow-out airflow. The airflow speed in the first airflow-speed region belongs to the highest airflow-speed range. A second airflow-speed region is a region hatched with fine lines diagonally downward to the right, and the airflow speed in the second airflow-speed region belongs to the second-highest airflow-speed range. A third airflow-speed region is a region hatched with coarse lines diagonally upward to the right, and the airflow speed in the third airflow-speed region belongs to the third-highest airflow-speed range. A fourth airflow-speed region is a region hatched with coarse lines diagonally downward to the right, and the airflow speed in the fourth airflow-speed region belongs to the lowest airflow-speed range.

As illustrated in FIG. 5, in the blow-out airflow in the wide mode, a region representing the airflow-speed peak (the first airflow-speed region) is divided in the up-down direction. Here, a state in which "the blow-out airflow is divided in the up-down direction" is, for example, a state in which, in the airflow-speed distribution view (FIG. 5) illustrating the airflow speed distribution of the blow-out airflow in a plane including the up-down direction and the front-back direction, a region representing the airflow-speed peak of the blow-out airflow (the first airflow-speed region in the example illustrated in FIG. 5) is divided into a plurality of regions. Preferably, the percentage of turbulent regions in the entirety of the blow-out air immediately after the blow-out air has been blown out from the blow-out port (15) in the wide mode (that is, near the blow-out port (15)) is less than 30%.

[Normal Mode]

Next, referring to FIGS. 6 and 7, the normal mode will be described. In this example, the normal mode is a blow-out mode in which a blow-out airflow is blown diagonally downward from the blow-out port (15).

As illustrated in FIG. 6, in the normal mode, the blow-out airflow is not divided in the up-down direction. In the normal mode, the blow-out airflow hits on a local part of the body of a user.

Note that a state in which a blow-out airflow hits on the body (for example, a part of the body) of a user is a state in which, for example, the airflow speed of the blow-out airflow that hits on the body of the user is higher than a predetermined minimum airflow speed. The minimum airflow speed may be set to the minimum value of the airflow speed of the blow-out airflow with which it can be regarded that a user can feel the blow-out air (for example, 0.3 m/s).

Figure 7:
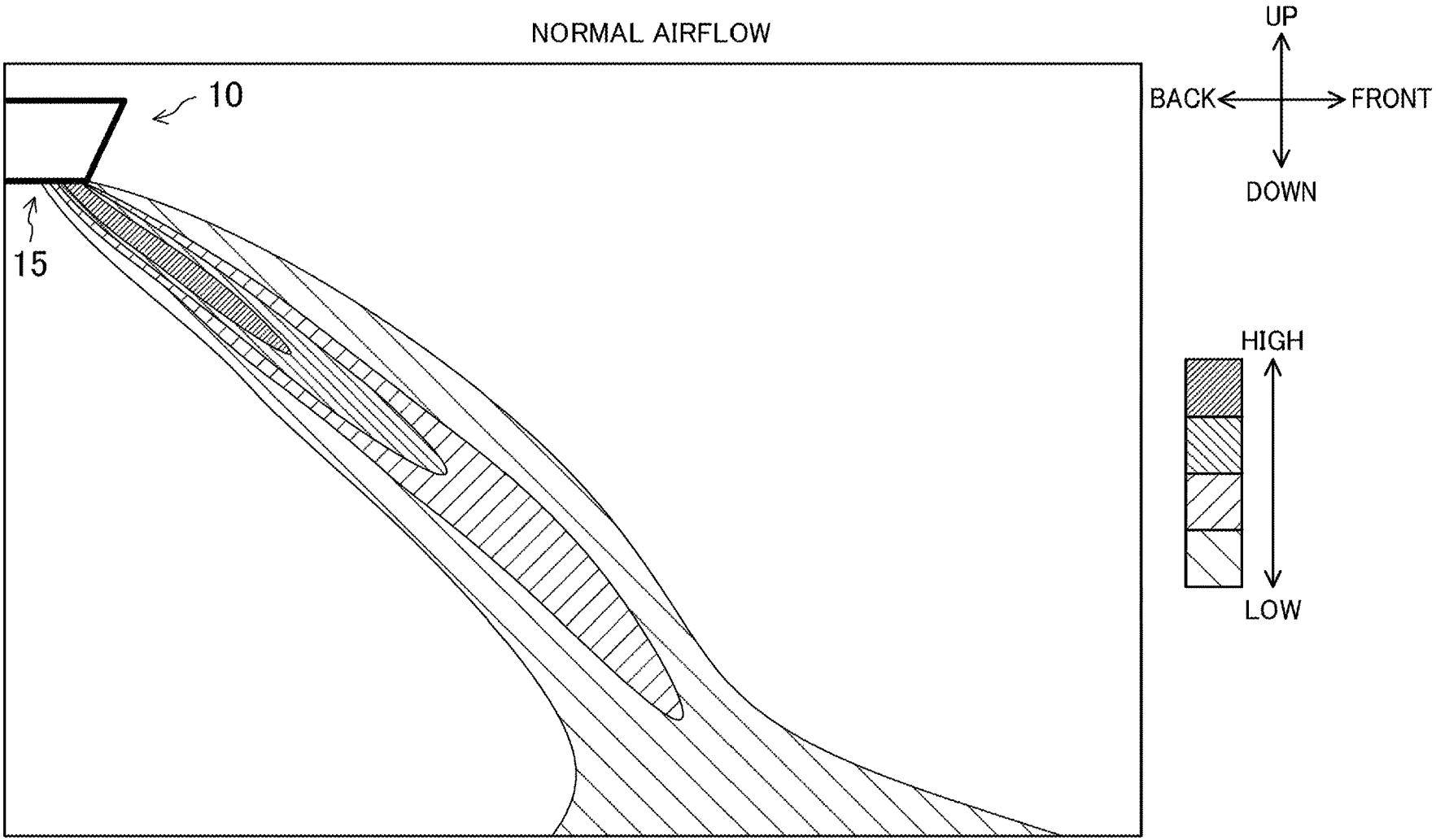
FIG. 7 is an airflow-speed distribution view illustrating an example of the airflow speed distribution of a blow-out airflow in the normal mode.

FIG. 7 illustrates an example of the airflow speed distribution of a blow-out airflow in the normal mode. In the example illustrated in FIG. 7, as with the example illustrated in FIG. 5, the airflow-speed region of the blow-out airflow is classified into four airflow-speed regions (first to fourth airflow-speed regions). As illustrated in FIG. 7, in the blow-out airflow in the normal mode, a region representing the airflow speed peak (the first airflow-speed region) is not divided in the up-down direction.

[Comparison Between Wide Mode and Normal Mode]

Figure 8:
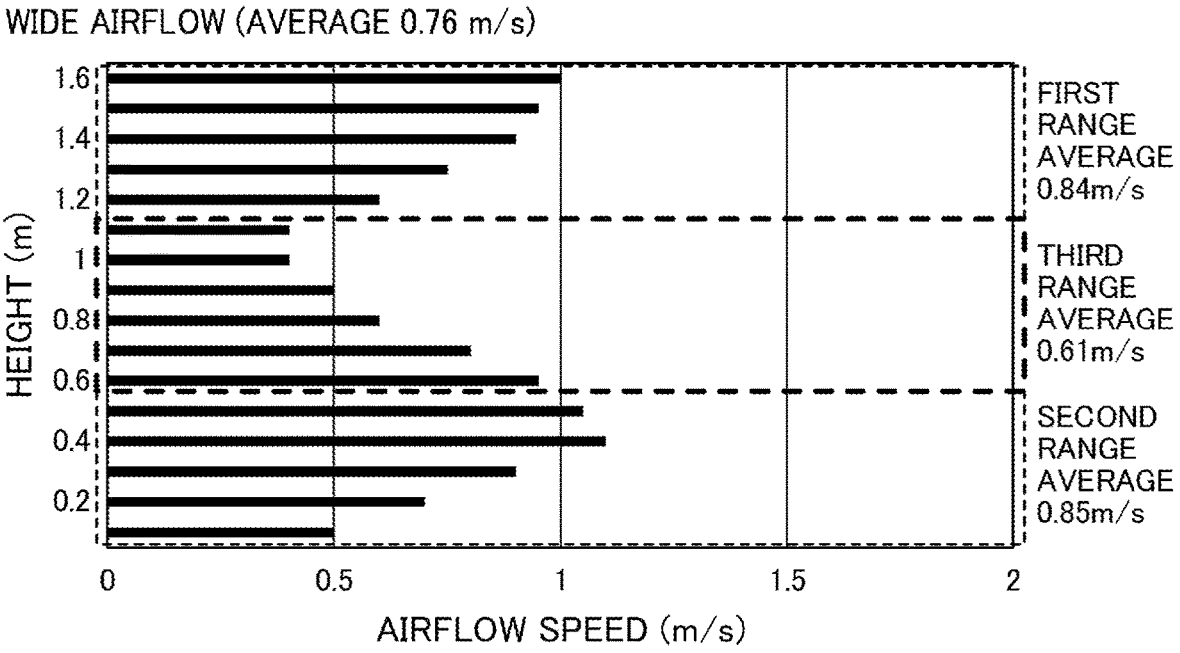
FIG. 8 is a graph representing an example of the airflow speed distribution of a blow-out airflow in the wide mode.
Figure 9:
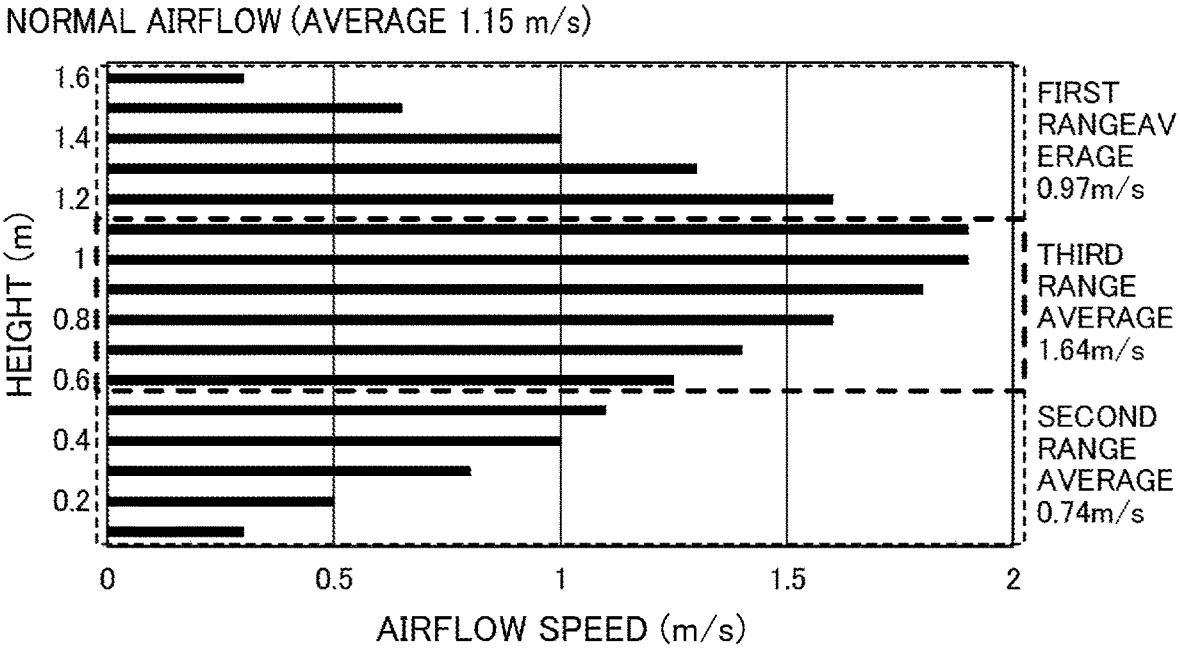
FIG. 9 is a graph representing an example of the airflow speed distribution of a blow-out airflow in the normal mode.

Next, referring to FIGS. 8 and 9, a blow-out airflow in the wide mode and a blow-out airflow in the normal mode will be compared with each other. FIG. 8 illustrates an example of the airflow speed distribution of a blow-out airflow in the wide mode, and FIG. 9 illustrates an example of the airflow speed distribution of a blow-out airflow in the normal mode. FIGS. 8 and 9 each illustrate an example of airflow speed in the reference height range (R10) that is measured at the reference point (P0) when the first point (P1) that is separated by 1000 mm ahead from the blow-out port (15) is defined as the reference point (P0) and the air-conditioning indoor unit (10) is provided in such a way that the reference position (Q) of the blow-out port (15) is a position that is separated by 2000 mm upward from a floor.

As illustrated in FIG. 8, in the blow-out airflow in the wide mode, the average airflow speed in the reference height range (R10) is "0.76 m/s". The average airflow speed in the first range (R11) is "0.84 m/s", the average airflow speed in the second range (R12) is "0.85 m/s", and the n average airflow speed in the third range (R13) is "0.61 m/s". In the example illustrated in FIG. 8, the difference between the average airflow speed in the first range (R11) and the average airflow speed in the second range (R12) is "0.01 m/s", and the average airflow speed in the first range (R11) and the average airflow speed in the second range (R12) are approximately equal to each other. The ratio of the average airflow speed in the third range (R13) to the average airflow speed in the first range (R11) is about 0.73, and the ratio of the average airflow speed in the third range (R13) to the average airflow speed in the first range (R11) is less than 1.5. In this way, in the wide mode under the test condition, an airflow-speed distribution condition that the average airflow speed in the first range (R11) and the average airflow speed in the second range (R12) are approximately equal to each other and the ratio of the average airflow speed in the third range (R13) to the average airflow speed in the first range (R11) is less than 1.5 is satisfied.

On the other hand, as illustrated in FIG. 9, in the blow-out airflow in the normal mode, the average airflow speed in the reference height range (R10) is "1.15 m/s". The average airflow speed in the first range (R11) is "0.97 m/s", the average airflow speed in the second range (R12) is "0.74 m/s", and the average airflow speed in the third range (R13) is "1.64 m/s". In the example illustrated in FIG. 9, the difference between the average airflow speed in the first range (R11) and the average airflow speed in the second range (R12) is "0.23 m/s", and the average airflow speed in the first range (R11) and the average airflow speed in the second range (R12) are not approximately equal to each other. The ratio of the average airflow speed in the third range (R13) to the average airflow speed in the first range (R11) is about 1.69, and the ratio of the average airflow speed in the third range (R13) to the average airflow speed in the first range (R11) is not less than 1.5. In this way, in the normal mode under the test condition, the aforementioned airflow-speed distribution condition is not satisfied.

Advantageous Effects of First Embodiment

As described above, an air-conditioning indoor unit (10) according to the first embodiment is provided on a side wall and has a wide mode. The air-conditioning indoor unit (10) includes: a casing (11) in which a suction port (14) and a blow-out port (15) are formed; a fan (12) provided in the casing (11); and an airflow adjusting mechanism (20) configured to adjust a blow-out airflow that is a flow of air blown out from the blow-out port (15). The blow-out port (15) extends in a left-right direction of the air-conditioning indoor unit (10). A length (L15) of the blow-out port (15) in a width direction perpendicular to an extension direction of the blow-out port (15) is less than or equal to 300 mm. A reference point (P0) is defined as at least one point that is positioned in a range, in a front-back direction, starting at a first point (P1) that is separated by 1000 mm ahead the air-conditioning indoor unit (10) from the blow-out port (15) and ending at a second point (P2) that is separated by 2000 mm ahead of the air-conditioning indoor unit (10) from the blow-out port (15). A reference height range (R10) is defined as a range, in an up-down direction, starting at the reference point (P0) and ending at a position that is separated by 1600 mm upward from the reference point (P0). Among three ranges obtained by trisecting the reference height range (R10) in the up-down direction, a first range (R11) is defined as a range positioned on an upper side, a second range (R12) is defined as a range positioned on a lower side, and a third range (R13) is defined as a range positioned at a center. Under a test condition that the air-conditioning indoor unit (10) is provided in such a way that a reference position (Q) of the blow-out port (15) is a position that is separated by 2000 mm upward from a floor, the airflow adjusting mechanism (20) adjusts, in the wide mode, the blow-out airflow so that an average airflow speed in the first range (R11) and an average airflow speed in the second range (R12) are approximately equal to each other and so that a ratio of an average airflow speed in the third range (R13) to the average airflow speed in the first range (R11) is less than 1.5.

With the configuration described above, it is possible to make the difference between the average airflow speed in the first range (R11) and the average airflow speed in the second range (R12) approximately zero. It is possible to make the difference between the average airflow speed in the first range (R11) and the average airflow speed in the third range (R13) less than 0.5 times the average airflow speed in the third range (R13). It is possible to make the difference between the average airflow speed in the second range (R12) and the average airflow speed in the third range (R13) less than approximately 0.5 times the average airflow speed in the third range (R13). In this way, because it is possible to reduce variation in the airflow speed of the blow-out airflow in the reference height range (R10), it is possible to blow the blow-out airflow, in which variation in airflow speed in the up-down direction is reduced, toward the whole body of a user. Thus, it is possible to reduce discomfort due to hitting of the blow-out airflow on a local part of the body.

In the air-conditioning indoor unit (10) according to the first embodiment, the airflow adjusting mechanism (20) adjusts, in the wide mode under the test condition, the blow-out airflow so that an average airflow speed in the reference height range (R10) is greater than or equal to 0.5 m/s.

With the configuration described above, it is possible to prevent the average airflow speed of the blow-out airflow in the reference height range (R10) from becoming too low. Thus, it is possible to effectively blow the blow-out airflow, in which variation in airflow speed in the up-down direction is reduced, toward the whole body of a user.

In the air-conditioning indoor unit (10) according to the first embodiment, the airflow adjusting mechanism (20) adjusts, in the wide mode under the test condition, the blow-out airflow so that an airflow-speed distribution condition that the average airflow speed in the first range (R11) and the average airflow speed in the second range (R12) are approximately equal to each other and that the ratio of the average airflow speed in the third range (R13) to the average airflow speed in the first range (R11) is less than 1.5 is satisfied in a range (R20), in the left-right direction, that is centered at a center position (Qc) of the blow-out port (15) in the left-right direction and that has a length in the left-right direction greater than or equal to 1000 mm.

With the configuration described above, in the range of greater than or equal to 1000 mm in the left-right direction, it is possible to satisfy an airflow-speed distribution condition that can reduce variation in the airflow speed of the blow-out airflow in the reference height range (R10). Thus, in the range in the left-right direction of greater than or equal to 1000 mm, it is possible to reduce discomfort due to hitting of the blow-out airflow on a local part of the body.

In the air-conditioning indoor unit (10) according to the first embodiment, the airflow adjusting mechanism (20) includes a first airflow-direction adjusting blade (31) provided near a back of the blow-out port (15) and a second airflow-direction adjusting blade (32) provided near a front of the blow-out port (15). The first airflow-direction adjusting blade (31) is configured to spread the blow-out airflow downward in the wide mode. The second airflow-direction adjusting blade (32) is configured to spread the blow-out airflow upward in the wide mode.

With the configuration described above, it is possible to spread the blow-out airflow in the up-down direction by using the first airflow-direction adjusting blade (31) and the second airflow-direction adjusting blade (32). Thus, it is possible to reduce variation in the airflow speed of the blow-out airflow in the reference height range (R10), and it is possible to blow the blow-out airflow, in which variation in airflow speed in the up-down direction is reduced, toward the whole body of a user. Thus, it is possible to reduce discomfort due to hitting of the blow-out airflow on a local part of the body.

In the air-conditioning indoor unit (10) according to the first embodiment, the first airflow-direction adjusting blade (31) and the second airflow-direction adjusting blade (32) are configured to divide the blow-out airflow in the up-down direction in the wide mode due to a Coanda effect.

With the configuration described above, it is possible to guide the blow-out airflow downward along the first airflow-direction adjusting blade (31) due to the Coanda effect of the first airflow-direction adjusting blade (31). Moreover, it is possible to guide the blow-out airflow upward along the second airflow-direction adjusting blade (32) due to the Coanda effect of the second airflow-direction adjusting blade (32). By dividing the blow-out airflow in the up-down direction by using these Coanda effects, it is possible to easily spread the blow-out airflow in the up-down direction.

In the air-conditioning indoor unit (10) according to the first embodiment, the second airflow-direction adjusting blade (32) is configured to be continuous with a front edge portion of the blow-out port (15).

With the configuration described above, by configuring the second airflow-direction adjusting blade (32) to be continuous with the front edge portion of the blow-out port (15), it is possible to smooth the flow of air from the blow-out port (15) toward the second airflow-direction adjusting blade (32). Thus, it is possible to smooth the upward spreading of the blow-out airflow by the second airflow-direction adjusting blade (32).

In the air-conditioning indoor unit (10) according to the first embodiment, the airflow adjusting mechanism (20) includes three or more auxiliary adjusting blades (35) provided at the blow-out port (15) to be arranged in the left-right direction. Each of the three or more auxiliary adjusting blades (35) is configured to divide the blow-out airflow in the left-right direction.

With the configuration described above, by dividing the blow-out airflow in the left-right direction, it is possible to spread the blow-out airflow in the left-right direction. Thus, it is possible to spread, in the left-right direction, the range to which the blow-out airflow, in which variation in airflow speed in the up-down direction is reduced, is blown.

Moreover, with the air-conditioning indoor unit (10) according to the first embodiment, because it is possible to generate the blow-out airflow in which variation in airflow speed in the up-down direction is reduced and that can be blown toward the whole body of a user (wide airflow), compared with a case where the blow-out airflow hits on a local part of the body of a user, it is possible to make change in temperature of the body of the user due to the blow-out airflow uniform. For example, it is possible to uniformly cool or warm the whole body of a user by using a wide airflow. Thus, because it is possible to reduce variation in the temperature distribution of the whole body of a user, it is possible to reduce the fatigue of the user caused by variation in temperature distribution.

Moreover, because it is possible to make change in the temperature of the whole body of a user due to the blow-out airflow uniform by generating the wide airflow, it is possible to more rapidly change the temperature of the whole body of the user than in a case where the blow-out airflow hits on a local part of the body of the user. For example, it is possible to rapidly cool or warm the whole body of a user. Thus, it is possible to reduce the power consumption of the air-conditioning indoor unit (10), because it is possible to make the time required to make the temperature of the whole body of a user (for example, the sensible temperature) a desirable temperature shorter than that in a case where a blow-out airflow hits on a local part of the body of a user.

When the wide airflow is compared with a blow-out airflow that hits on a local part of the body of a user (hereafter, referred to as "local airflow"), the air-passing range (range in which airflow passes) of the wide airflow in the up-down direction is larger than that of the local airflow in the up-down direction. Accordingly, when it is assumed that the flow rate of air blown out from the blow-out port (15) is constant, the average airflow speed of the wide airflow in the up-down direction is lower than the average airflow speed of the local airflow in the up-down direction. Therefore, by supplying the wide airflow to a user, it is possible to reduce the draft sensation of a user, compared with a case where the local airflow is supplied to the user.

Moreover, by supplying the wide airflow to a user, it is possible to reproduce an airflow like natural wind that flows around the whole body of a user. Thus, it is possible to improve the comfort of a user.

(Modifications of Airflow Adjusting Mechanism of First Embodiment)

As illustrated in FIGS. 10 to 13, in the air-conditioning indoor unit (10) according to the first embodiment, the airflow adjusting mechanism (20) may include at least one third airflow-direction adjusting blade (33), in addition to the first airflow-direction adjusting blade (31) and the second airflow-direction adjusting blade (32).

[Third Airflow-Direction Adjusting Blade]

The third airflow-direction adjusting blade (33) has a plate-like shape extending in the extension direction of the blow-out port (15), and is provided at the blow-out port (15) between the first airflow-direction adjusting blade (31) and the second airflow-direction adjusting blade (32). The third airflow-direction adjusting blade (33) is switchable among a plurality of positions at inclination angles that differ from each other (angles around a swing axis extending in the extension direction of the blow-out port (15)).

To be specific, a third swing axis (not shown) is fixed to a base portion (one edge portion in the width direction) of the third airflow-direction adjusting blade (33). The third swing axis is swingably supported by the casing (11). A third motor (not shown) is coupled to the third swing axis. When the third motor is driven, the third airflow-direction adjusting blade (33) swings around the third swing axis, and the position of the third airflow-direction adjusting blade (33) is switched.

In this example, the third airflow-direction adjusting blade (33) extends in the extension direction of the blow-out port (15) without being divided in the extension direction of the blow-out port (15).

[First Airflow-Direction Adjusting Blade and Second Airflow-Direction Adjusting Blade]

The configurations of the first airflow-direction adjusting blade (31) and the second airflow-direction adjusting blade (32) illustrated in FIGS. 10 to 13 are similar to the configurations of the first airflow-direction adjusting blade (31) and the second airflow-direction adjusting blade (32) illustrated in FIG. 1. In FIGS. 10 to 13, illustrations of the first swing axis (311) and the second swing axis (321) are omitted.

[The Other Configurations of Air-Conditioning Indoor Unit]

The other configurations of the air-conditioning indoor unit (10) illustrated in FIGS. 10 to 13 are similar to those of the air-conditioning indoor unit (10) illustrated in FIG. 1.

[First Modification of Airflow Adjusting Mechanism]

Figure 10:
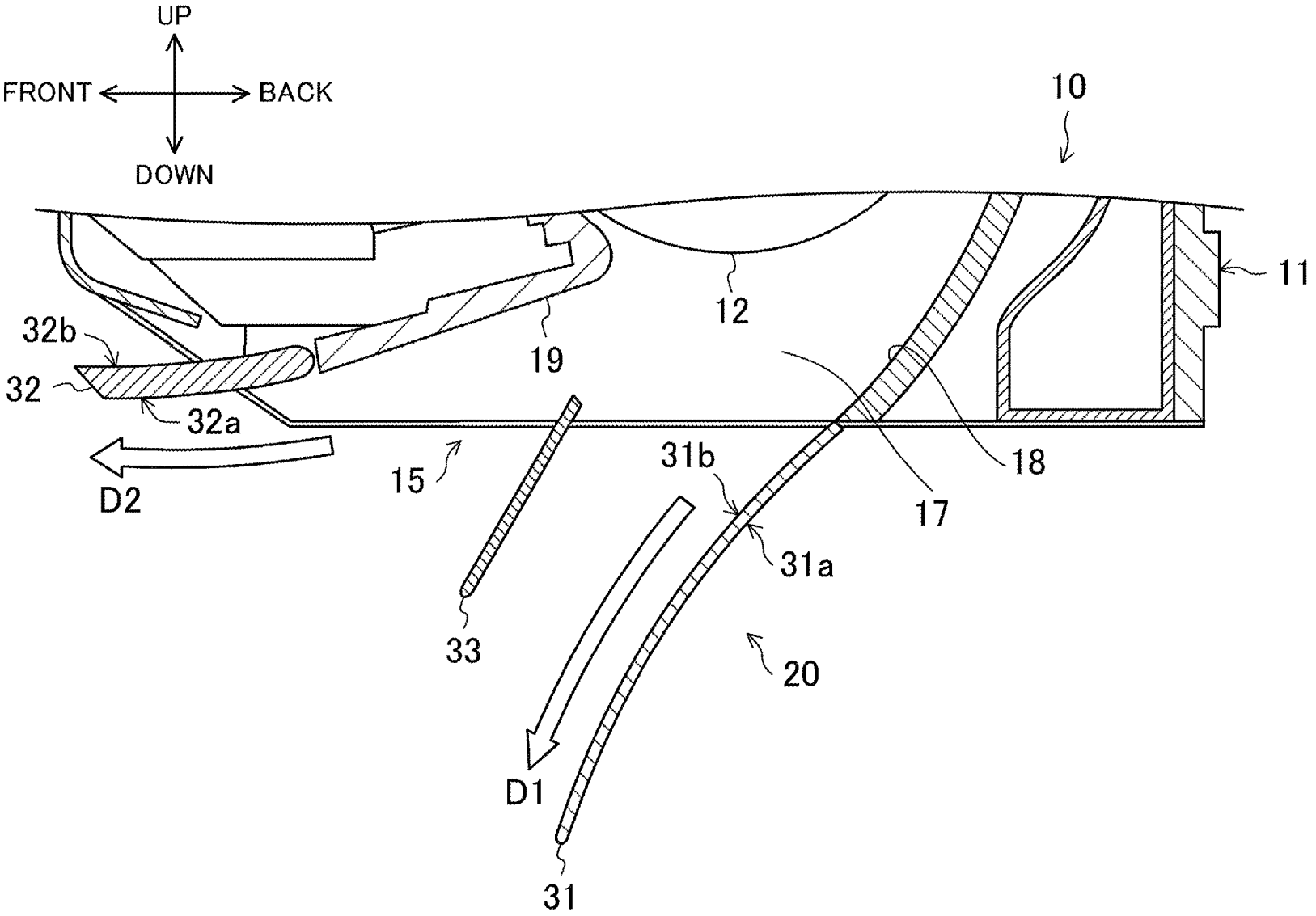
FIG. 10 is a sectional view illustrating an example of the configuration of a first modification of an airflow adjusting mechanism.

FIG. 10 illustrates an example of the configuration of a first modification of the airflow adjusting mechanism and the positions of the airflow-direction adjusting blades in the wide mode. In the first modification of the airflow adjusting mechanism, the first airflow-direction adjusting blade (31) is configured to be continuous with the back edge portion of the blow-out port (15). The second airflow-direction adjusting blade (32) is configured to be continuous with the front edge portion of the blow-out port (15). The third airflow-direction adjusting blade (33) is disposed at a central part of the blow-out port (15) in the width direction (the front-back direction of the air-conditioning indoor unit (10)).

In the first modification of the airflow adjusting mechanism, a blow-out airflow is divided by the third airflow-direction adjusting blade (33) in the up-down direction. To be specific, the blow-out airflow is divided into a first airflow (D1) generated between the first airflow-direction adjusting blade (31) and the third airflow-direction adjusting blade (33) and a second airflow (D2) generated between the third airflow-direction adjusting blade (33) and the second airflow-direction adjusting blade (32).

[Second Modification of Airflow Adjusting Mechanism]

Figure 11:
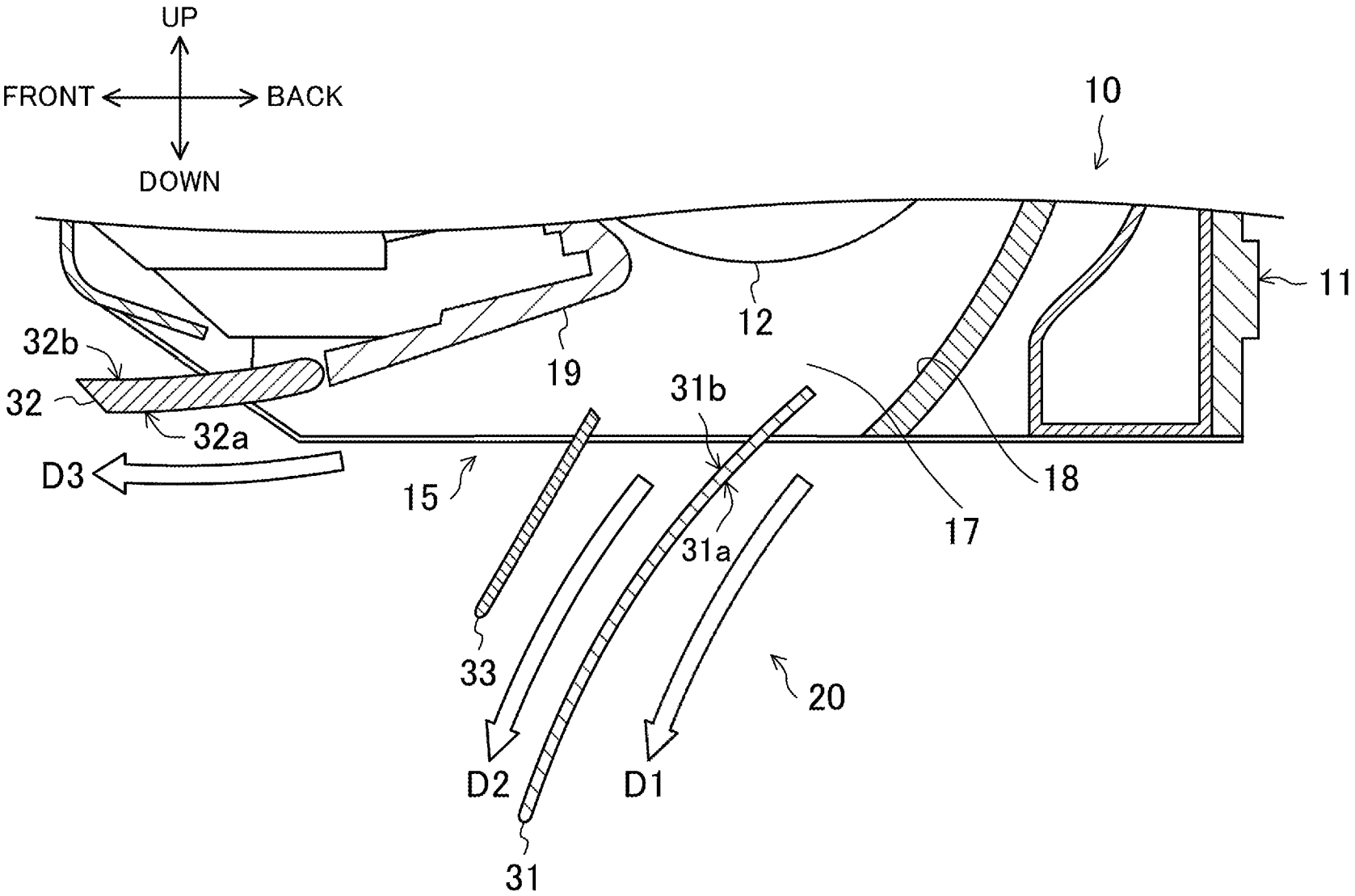
FIG. 11 is a sectional view illustrating an example of the configuration of a second modification of the airflow adjusting mechanism.

FIG. 11 illustrates an example of the configuration of a second modification of the airflow adjusting mechanism and the positions of the airflow-direction adjusting blades in the wide mode. In the second modification of the airflow adjusting mechanism, the first airflow-direction adjusting blade (31) is configured to be separated from the back edge portion of the blow-out port (15). The configurations of the second airflow-direction adjusting blade (32) and the third airflow-direction adjusting blade (33) in the second modification of the airflow adjusting mechanism are similar to the configurations of the second airflow-direction adjusting blade (32) and the third airflow-direction adjusting blade (33) in the first modification of the airflow adjusting mechanism illustrated in FIG. 10.

In the second modification of the airflow adjusting mechanism, a blow-out airflow is divided in the up-down direction by the first airflow-direction adjusting blade (31) and the third airflow-direction adjusting blade (33). To be specific, the blow-out airflow is divided into a first airflow (D1) generated on the outer surface (31*a*) side of the first airflow-direction adjusting blade (31), a second airflow (D2) generated between the first airflow-direction adjusting blade (31) and the third airflow-direction adjusting blade (33), and a third airflow (D3) generated between the third airflow-direction adjusting blade (33) and the second airflow-direction adjusting blade (32).

In the second modification of the airflow adjusting mechanism, in the wide mode, the Coanda effect is increased by increasing the curvature of the terminal end portion of the front-side scroll (19) in order to suppress separation of an airflow from the front-side scroll (19). The distance between the base portion of the third airflow-direction adjusting blade (33) and the front-side scroll (19) is shorter than the distance between the third airflow-direction adjusting blade (33) and the back-side scroll (18).

In the second modification of the airflow adjusting mechanism, in order to suppress separation of an airflow from the first airflow-direction adjusting blade (31) in the wide mode, a path of airflow is formed on the outer surface (31*a*) side of the first airflow-direction adjusting blade (31) by separating the base portion of the first airflow-direction adjusting blade (31) from the terminal end (F) of the back-side scroll (18) (the back edge portion of the blow-out port (15)).

In the second modification of the airflow adjusting mechanism, the shape (for example, the bend angle) and the disposition of the third airflow-direction adjusting blade (33) are determined so that the blow-out airflow is separated by the inner surface of the third airflow-direction adjusting blade (33) (a surface on the second airflow-direction adjusting blade (32) side in FIG. 11) and bisected by a tip portion of the third airflow-direction adjusting blade (33) in the wide mode. Moreover, the shape and the disposition of the third airflow-direction adjusting blade (33) are determined so that the distance between a central portion of the first airflow-direction adjusting blade (31) and the tip portion of the third airflow-direction adjusting blade (33) is short. Furthermore, in order to suppress separation of an airflow from the first airflow-direction adjusting blade (31), the bend angle of the first airflow-direction adjusting blade (31) is determined so that the bend angle of the first airflow-direction adjusting blade (31) gradually increases toward the tip of the first airflow-direction adjusting blade (31). For example, the bend angle of the first airflow-direction adjusting blade (31) may gradually change from 33° to 39° and gradually change from 39° to 45°, or gradually change from 50° to 55° and gradually change from 55° to 60°.

[Third Modification of Airflow Adjusting Mechanism]

Figure 12:
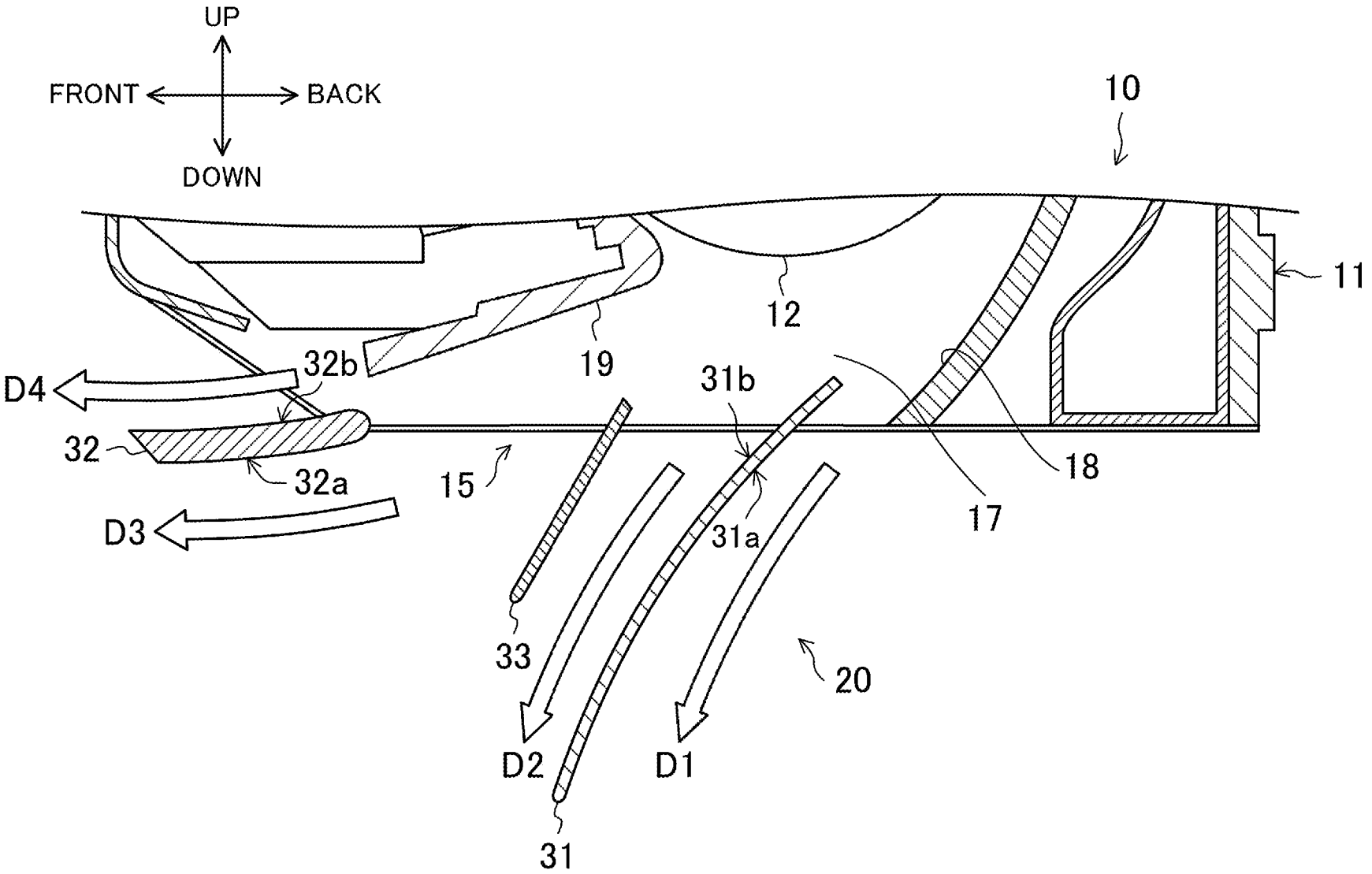
FIG. 12 is a sectional view illustrating an example of the configuration of a third modification of the airflow adjusting mechanism.

FIG. 12 illustrates an example of the configuration of a third modification of the airflow adjusting mechanism and the positions of the airflow-direction adjusting blades in the wide mode. In the third modification of the airflow adjusting mechanism, the second airflow-direction adjusting blade (32) is configured to be separated from the front edge portion of the blow-out port (15). The configurations of the first airflow-direction adjusting blade (31) and the third airflow-direction adjusting blade (33) in the third modification of the airflow adjusting mechanism are similar to the configurations of the first airflow-direction adjusting blade (31) and the third airflow-direction adjusting blade (33) in the second modification of the airflow adjusting mechanism illustrated in FIG. 11.

In the third modification of the airflow adjusting mechanism, a blow-out airflow is divided in the up-down direction by the first airflow-direction adjusting blade (31), the second airflow-direction adjusting blade (32), and the third airflow-direction adjusting blade (33). To be specific, the blow-out airflow is divided into a first airflow (D1) generated on the outer surface (31*a*) side of the first airflow-direction adjusting blade (31), a second airflow (D2) generated between the first airflow-direction adjusting blade (31) and the third airflow-direction adjusting blade (33), a third airflow (D3) generated between the third airflow-direction adjusting blade (33) and the second airflow-direction adjusting blade (32), and a fourth airflow (D4) generated on the inner surface (32*b*) side of the second airflow-direction adjusting blade (32).

[Fourth Modification of Airflow Adjusting Mechanism]

Figure 13:
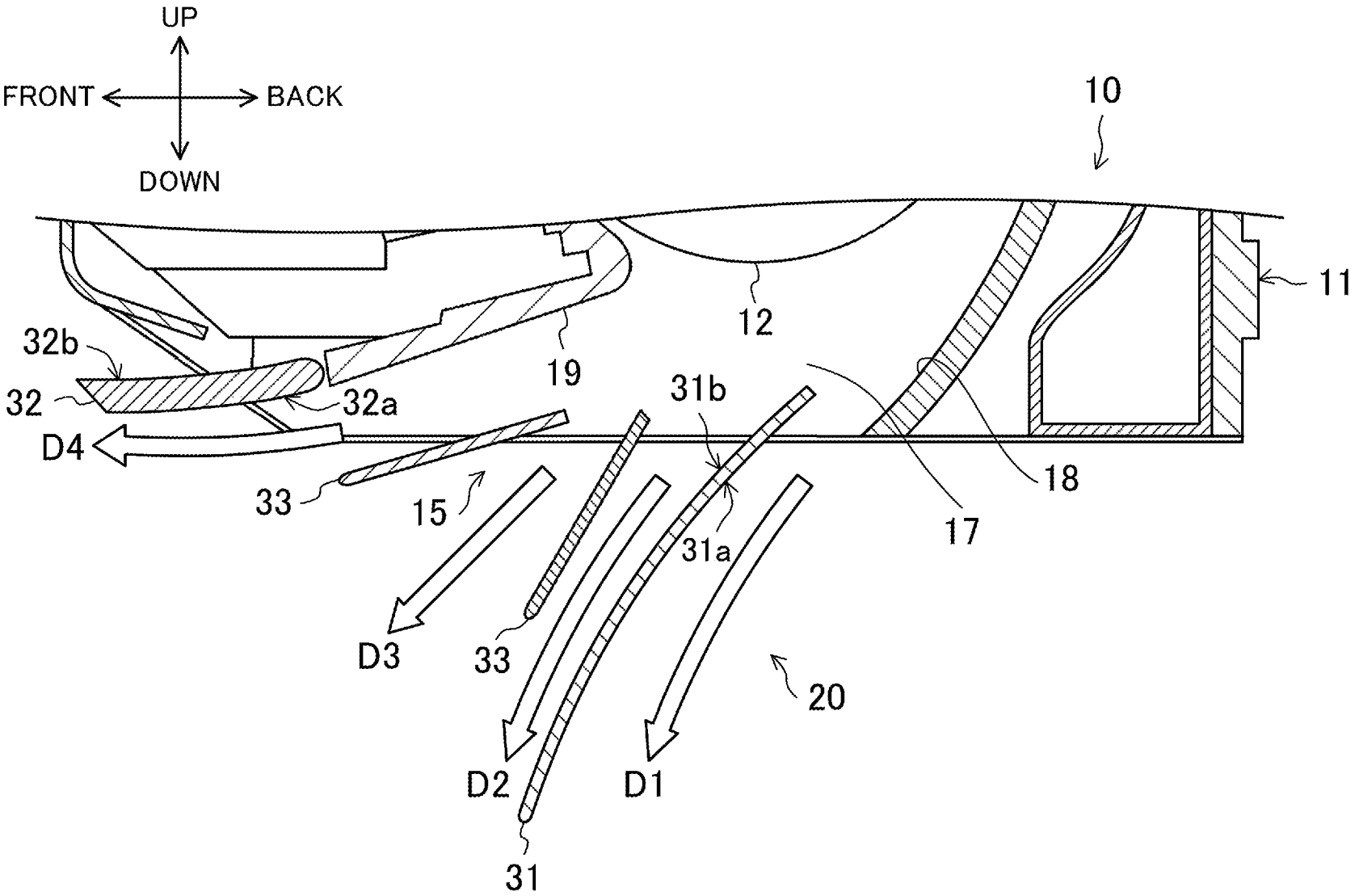
FIG. 13 is a sectional view illustrating an example of the configuration of a fourth modification of the airflow adjusting mechanism.

FIG. 13 illustrates an example of the configuration of a fourth modification of the airflow adjusting mechanism and the positions of the airflow-direction adjusting blades in the wide mode. In the fourth modification of the airflow adjusting mechanism, two third airflow-direction adjusting blades (33) are provided at the blow-out port (15). The two third airflow-direction adjusting blades (33) are arranged in the extension direction of the blow-out port (15) (the left-right direction of the air-conditioning indoor unit (10)). The configurations of the first airflow-direction adjusting blade (31) and the second airflow-direction adjusting blade (32) in the fourth modification of the airflow adjusting mechanism are similar to the configurations of the first airflow-direction adjusting blade (31) and the second airflow-direction adjusting blade (32) in the second modification of the airflow adjusting mechanism illustrated in FIG. 11.

In the fourth modification of the airflow adjusting mechanism, a blow-out airflow is divided in the up-down direction by the first airflow-direction adjusting blade (31) and the two third airflow-direction adjusting blades (33). To be specific, the blow-out airflow is divided into a first airflow (D1) generated on the outer surface (31*a*) side of the first airflow-direction adjusting blade (31), a second airflow (D2) generated between the first airflow-direction adjusting blade (31) and one of the third airflow-direction adjusting blades (33), a third airflow (D3) generated between the one of the third airflow-direction adjusting blades (33) and the other third airflow-direction adjusting blade (33), and a fourth airflow (D4) generated between the other third airflow-direction adjusting blade (33) and the second airflow-direction adjusting blade (32).

[Advantageous Effects of Modifications of Airflow Adjusting Mechanism of First Embodiment]

As described above, in each of the modifications (to be specific, the first to fourth modifications) of the airflow adjusting mechanism of the first embodiment, the airflow adjusting mechanism (20) includes at least one third airflow-direction adjusting blade (33) provided between the first airflow-direction adjusting blade (31) and the second airflow-direction adjusting blade (32). The third airflow-direction adjusting blade (33) is configured to divide the blow-out airflow in the up-down direction in the wide mode.

With the configuration described above, it is easy to spread the blow-out airflow in the up-down direction by separating the blow-out airflow in the up-down direction by using the third airflow-direction adjusting blade (33).

In each of the modifications (to be specific, the first to fourth modifications) of the airflow adjusting mechanism of the first embodiment, each of the first airflow-direction adjusting blade (31), the second airflow-direction adjusting blade (32), and the third airflow-direction adjusting blade (33) extends in the extension direction of the blow-out port (15) without being divided in the extension direction of the blow-out port (15).

With the configuration described above, because each of the first airflow-direction adjusting blade (31), the second airflow-direction adjusting blade (32), and the third airflow-direction adjusting blade (33) is not divided in the extension direction of the blow-out port (15), it is possible to avoid leakage of the blow-out airflow from a gap that is formed if the airflow-direction adjusting blade is divided. Thus, it is possible to easily spread the blow-out airflow in the up-down direction by using the first airflow-direction adjusting blade (31), the second airflow-direction adjusting blade (32), and the third airflow-direction adjusting blade (33).

In some of the modifications (to be specific, the first, second, and fourth modifications) of the airflow adjusting mechanism of the first embodiment, the second airflow-direction adjusting blade (32) is configured to be continuous with a front edge portion of the blow-out port (15).

With the configuration described above, by configuring the second airflow-direction adjusting blade (32) to be continuous with the front edge portion of the blow-out port (15), it is possible to smooth the flow of air from the blow-out port (15) toward the second airflow-direction adjusting blade (32). Thus, it is possible to smooth the upward spreading of the blow-out airflow by the second airflow-direction adjusting blade (32).

(Modification of Wide Airflow-Speed Distribution Condition of First Embodiment)

In the air-conditioning indoor unit (10) according to the first embodiment, the airflow adjusting mechanism (20) may be configured to adjust, in the wide mode under the test condition, the blow-out airflow so that the average airflow speed in the first range (R11) and the average airflow speed in the second range (R12) are approximately equal to each other and so that the ratio of the average airflow speed in the third range (R13) to the average airflow speed in the first range (R11) is less than 1.1 and greater than or equal to 0.5.

The airflow adjusting mechanism (20) may be configured to adjust, in the wide mode under the test condition, the blow-out airflow so that an airflow-speed distribution condition (wide airflow-speed distribution condition) that the average airflow speed in the first range (R11) and the average airflow speed in the second range (R12) are approximately equal to each other and that the ratio of the average airflow speed in the third range (R13) to the average airflow speed in the first range (R11) is less than 1.1 and greater than or equal to 0.5 is satisfied in a range (R20), in the left-right direction, that is centered at a center position (Qc) of the blow-out port (15) in the left-right direction and that has a length in the left-right direction greater than or equal to 1000 mm.

[Advantageous Effects of Modification of Wide Airflow-Speed Distribution Condition of First Embodiment]

As described above, in the modification of the wide airflow-speed distribution condition of the first embodiment, the airflow adjusting mechanism (20) adjusts, in the wide mode under the test condition, the blow-out airflow so that the average airflow speed in the first range (R11) and the average airflow speed in the second range (R12) are approximately equal to each other and so that the ratio of the average airflow speed in the third range (R13) to the average airflow speed in the first range (R11) is less than 1.1 and greater than or equal to 0.5.

With the configuration described above, it is possible to make the difference between the average airflow speed in the first range (R11) and the average airflow speed in the second range (R12) approximately zero. It is possible to make the difference between the average airflow speed in the first range (R11) and the average airflow speed in the third range (R13) less than 0.1 to 0.5 times the average airflow speed in the third range (R13). It is possible to make the difference between the average airflow speed in the second range (R12) and the average airflow speed in the third range (R13) less than approximately 0.1 to 0.5 times the average airflow speed in the third range (R13). In this way, because it is possible to reduce variation in the airflow speed of the blow-out airflow in the reference height range (R10), it is possible to blow the blow-out airflow, in which variation in airflow speed in the up-down direction is reduced, toward the whole body of a user. Thus, it is possible to reduce discomfort due to hitting of the blow-out airflow on a local part of the body.

Second Embodiment

The configuration of an air-conditioning indoor unit (10) according to a second embodiment is similar to the configuration of the air-conditioning indoor unit (10) according to the first embodiment illustrated in FIGS. 1 and 2. For example, in this example, the length (L15) of the blow-out port (15) in the width direction is less than or equal to 300 mm. In other words, the shape of the opening of the blow-out port (15) is such that the length of a short side of a rectangle that circumscribes the opening is less than or equal to 300 mm. Here, the "rectangle that circumscribes the opening of the blow-out port (15)" is the smallest rectangle in which the entirety of the opening of the blow-out port (15) is included. The length of the short side of the rectangle of the blow-out port (15) may be less than or equal to 150 mm. The longitudinal direction of the rectangle that circumscribes the opening of the blow-out port (15) is a horizontal direction.

In the following description, "reference point (P0)", "reference height range (R10)", "first range (R11)", "second range (R12)", "third range (R13)", and "test condition" are respectively similar to "reference point (P0)", "reference height range (R10)", "first range (R11)", "second range (R12)", "third range (R13)", and "test condition" in the first embodiment.

With the air-conditioning indoor unit (10) according to the second embodiment, it is possible to set the direction of a blow-out airflow in the wide mode to be a direction toward a predetermined range in the up-down direction different from the reference height range (R10). For example, the predetermined range in the up-down direction may be a range such that the reference height range (R10) is shifted upward (as a specific example, a range in the up-down direction starting at a position that is separated by 500 mm from a floor and ending at a position that is separated by 2100 mm from the floor and having a length of 1600 mm). In the wide mode, the airflow direction of the blow-out airflow may be fixed or may be variable in the up-down direction.

The air-conditioning indoor unit (10) of the second embodiment is configured so that, under a test condition, when the direction of a blow-out airflow is adjusted so that the average airflow speed in the first range (R11) and the average airflow speed in the second range (R12) are approximately equal to each other, the ratio of the average airflow speed in the third range (R13) to the average airflow speed in the first range (R11) is less than 1.5. To be specific, with the air-conditioning indoor unit (10) of the second embodiment, under the test condition, when the direction of a blow-out airflow is adjusted so that the airflow direction of the blow-out airflow is a direction toward the reference height range (R10) and so that the average airflow speed in the first range (R11) and the average airflow speed in the second range (R12) are approximately equal to each other, the ratio of the average airflow speed in the third range (R13) to the average airflow speed in the first range (R11) is less than 1.5.

The adjustment of the airflow direction of the blow-out airflow may be performed by adjusting the setting angle (inclination angle with respect to the horizontal direction) of the air-conditioning indoor unit (10). The adjustment of the airflow direction of the blow-out airflow may be performed by adjusting the inclination angle of the first airflow-direction adjusting blade (31) and the inclination angle of the second airflow-direction adjusting blade (32). In this case, preferably, the inclination angle of the first airflow-direction adjusting blade (31) and the inclination angle of the second airflow-direction adjusting blade (32) are adjusted so that the angle between the first airflow-direction adjusting blade (31) and the second airflow-direction adjusting blade (32) is maintained constant.

In this example, the air-conditioning indoor unit (10) of the second embodiment is configured so that, under the test condition, an airflow-speed distribution condition that, when the direction of a blow-out airflow is adjusted so that the average airflow speed in the first range (R11) and the average airflow speed in the second range (R12) are approximately equal to each other, the ratio of the average airflow speed in the third range (R13) to the average airflow speed in the first range (R11) is less than 1.5 is satisfied in the range (R20), in the left-right direction, that is centered at the center position (Qc) in the left-right direction of the blow-out port (15) and that has a length in the left-right direction greater than or equal to 1000 mm. To be specific, in the air-conditioning indoor unit (10) of the second embodiment, under the test condition, when the direction of a blow-out airflow is adjusted so that the airflow direction of the blow-out airflow is a direction toward the reference height range (R10) and so that the average airflow speed in the first range (R11) and the average airflow speed in the second range (R12) are approximately equal to each other, an airflow-speed distribution condition that the ratio of the average airflow speed in the third range (R13) to the average airflow speed in the first range (R11) is less than 1.5 is satisfied in the range (R20) in the left-right direction. The left-right direction described above corresponds to the longitudinal direction of the rectangle that circumscribes the opening of the blow-out port (15).

The air-conditioning indoor unit (10) of the second embodiment is configured so that, under the test condition, when the direction of a blow-out airflow is adjusted so that the average airflow speed in the first range (R11) and the average airflow speed in the second range (R12) are approximately equal to each other, the average airflow speed in the reference height range (R10) is greater than or equal to 0.5 m/s. To be specific, in the air-conditioning indoor unit (10) of the second embodiment, under the test condition, when the direction of a blow-out airflow is adjusted so that the airflow direction of the blow-out airflow is a direction toward the reference height range (R10) and so that the average airflow speed in the first range (R11) and the average airflow speed in the second range (R12) are approximately equal to each other, the average airflow speed in the reference height range (R10) is greater than or equal to 0.5 m/s.

Advantageous Effects of Second Embodiment

As described above, the air-conditioning indoor unit (10) according to the second embodiment includes: a casing (11) in which a suction port (14) and a blow-out port (15) are formed; a fan (12) provided in the casing (11); and an airflow adjusting mechanism (20) configured to adjust a blow-out airflow that is a flow of air blown out from the blow-out port (15). A shape of an opening of the blow-out port (15) is such that a length of a short side of a rectangle that circumscribes the opening is less than or equal to 300 mm. Under a test condition that the air-conditioning indoor unit (10) is provided in such a way that a reference position (Q) of the blow-out port (15) is a position that is separated by 2000 mm upward from a floor, a reference point (P0) is defined as at least one point that is positioned in a range, in a front-back direction, starting at a first point (P1) that is separated by 1000 mm ahead of the air-conditioning indoor unit (10) from a point on the floor directly below the reference position (Q) of the blow-out port (15) and ending at a second point (P2) that is separated by 2000 mm ahead of the air-conditioning indoor unit (10) from the point on the floor directly below the reference position (Q) of the blow-out port (15). A reference height range (R10) is defined as a range, in an up-down direction, starting at the reference point (P0) and ending at a position that is separated by 1600 mm upward from the reference point (P0). Among three ranges obtained by trisecting the reference height range (R10) in the up-down direction, a first range (R11) is defined as a range positioned on an upper side, a second range (R12) is defined as a range positioned on a lower side, and a third range (R13) is defined as a range positioned at a center. Under the test condition that the air-conditioning indoor unit (10) is provided in such a way that the reference position (Q) of the blow-out port (15) is a position that is separated by 2000 mm upward from the floor, when an airflow direction of the blow-out airflow is adjusted so that an average airflow speed in the first range (R11) and an average airflow speed in the second range (R12) are approximately equal to each other, a ratio of an average airflow speed in the third range (R13) to the average airflow speed in the first range (R11) is less than 1.5.

With the configuration described above, because it is possible to reduce variation in the airflow speed of the blow-out airflow in a predetermined range in the up-down direction, it is possible to blow the blow-out airflow, in which variation in airflow speed in the up-down direction is reduced, toward the whole body of a user. Thus, it is possible to reduce discomfort due to hitting of the blow-out airflow on a local part of the body.

With the air-conditioning indoor unit (10) according to the second embodiment, under the test condition, when the direction of the blow-out airflow is adjusted so that the average airflow speed in the first range (R11) and the average airflow speed in the second range (R12) are approximately equal to each other, an average airflow speed in the reference height range (R10) is greater than or equal to 0.5 m/s.

With the configuration described above, it is possible to prevent the average airflow speed of the blow-out airflow in the predetermined range in the up-down direction from becoming too low. Thus, it is possible to effectively blow the blow-out airflow, in which variation in airflow speed in the up-down direction is reduced, toward the whole body of a user.

In the air-conditioning indoor unit (10) according to the second embodiment. under the test condition, when the airflow direction of the blow-out airflow is adjusted so that the average airflow speed in the first range (R11) and the average airflow speed in the second range (R12) are approximately equal to each other, an airflow-speed distribution condition that the ratio of the average airflow speed in the third range (R13) to the average airflow speed in the first range (R11) is less than 1.5 is satisfied in a range (R20), in a longitudinal direction of the rectangle, that is centered at a center position (Qc) of the blow-out port (15) (to be specific, the rectangle that circumscribes the opening of the blow-out port (15)) in the longitudinal direction of the rectangle and that has a length in the longitudinal direction of the rectangle greater than or equal to 1000 mm.

With the configuration described above, in the range of greater than or equal to 1000 mm in the predetermined direction (to be specific, the longitudinal direction of the rectangle that circumscribes the opening of the blow-out port (15)), it is possible to satisfy an airflow-speed distribution condition that can reduce variation in the airflow speed of the blow-out airflow in a predetermined range in the up-down direction. Thus, in the predetermined-direction range of greater than or equal to 1000 mm, it is possible to reduce discomfort due to hitting of the blow-out airflow on a local part of the body.

In the air-conditioning indoor unit (10) according to the second embodiment, the airflow adjusting mechanism (20) includes a first airflow-direction adjusting blade (31) provided near a back of the blow-out port (15) and a second airflow-direction adjusting blade (32) provided near a front of the blow-out port (15). The first airflow-direction adjusting blade (31) is configured to spread the blow-out airflow downward. The second airflow-direction adjusting blade (32) is configured to spread the blow-out airflow upward.

With the configuration described above, it is possible to spread the blow-out airflow in the up-down direction by using the first airflow-direction adjusting blade (31) and the second airflow-direction adjusting blade (32). Thus, it is possible to reduce variation in the airflow speed of the blow-out airflow in the predetermined range in the up-down direction, and it is possible to blow the blow-out airflow, in which variation in airflow speed in the up-down direction is reduced, toward the whole body of a user. Thus, it is possible to reduce discomfort due to hitting of the blow-out airflow on a local part of the body.

In the air-conditioning indoor unit (10) according to the second embodiment, the first airflow-direction adjusting blade (31) and the second airflow-direction adjusting blade (32) are configured to divide the blow-out airflow in the up-down direction due to a Coanda effect.

With the configuration described above, it is possible to guide the blow-out airflow downward along the first airflow-direction adjusting blade (31) due to the Coanda effect of the first airflow-direction adjusting blade (31). Moreover, it is possible to guide the blow-out airflow upward along the second airflow-direction adjusting blade (32) due to the Coanda effect of the second airflow-direction adjusting blade (32). By dividing the blow-out airflow in the up-down direction by using these Coanda effects, it is possible to easily spread the blow-out airflow in the up-down direction.

In the air-conditioning indoor unit (10) according to the second embodiment, the second airflow-direction adjusting blade (32) is configured to be continuous with a front edge portion of the blow-out port (15).

With the configuration described above, by configuring the second airflow-direction adjusting blade (32) to be continuous with the front edge portion of the blow-out port (15), it is possible to smooth the flow of air from the blow-out port (15) toward the second airflow-direction adjusting blade (32). Thus, it is possible to smooth the upward spreading of the blow-out airflow by the second airflow-direction adjusting blade (32).

In the air-conditioning indoor unit (10) according to the second embodiment, the airflow adjusting mechanism (20) includes three or more auxiliary adjusting blades (35) provided at the blow-out port (15) to be arranged in a longitudinal direction of the rectangle of the blow-out port (15). Each of the three or more auxiliary adjusting blades (35) is configured to divide the blow-out airflow in the longitudinal direction of the rectangle of the blow-out port (15).

With the configuration described above, by dividing the blow-out airflow in the longitudinal direction of the rectangle of the blow-out port (15), it is possible to spread the blow-out airflow in the longitudinal direction of the rectangle of the blow-out port (15). Thus, it is possible to spread, in the longitudinal direction of the rectangle of the blow-out port (15), the range to which the blow-out airflow, in which variation in airflow speed in the up-down direction is reduced, is blown.

(Modifications of Airflow Adjusting Mechanism of Second Embodiment)

As with the modifications of the airflow adjusting mechanism of the first embodiment of the first embodiment illustrated in FIGS. 10 to 13, in the air-conditioning indoor unit (10) according to the second embodiment, the airflow adjusting mechanism (20) may include at least one third airflow-direction adjusting blade (33), in addition to the first airflow-direction adjusting blade (31) and the second airflow-direction adjusting blade (32). The third airflow-direction adjusting blade (33) is provided between the first airflow-direction adjusting blade (31) and the second airflow-direction adjusting blade (32). The third airflow-direction adjusting blade (33) is configured to divide the blow-out airflow in the up-down direction.

With the configuration described above, it is easy to spread the blow-out airflow in the up-down direction by separating the blow-out airflow in the up-down direction by using the third airflow-direction adjusting blade (33).

As with the modifications of the airflow adjusting mechanism of the first embodiment illustrated in FIGS. 10 to 13, in the air-conditioning indoor unit (10) according to the second embodiment, when the airflow adjusting mechanism (20) includes the first airflow-direction adjusting blade (31), the second airflow-direction adjusting blade (32), and at least one the third airflow-direction adjusting blade (33), each of the first airflow-direction adjusting blade (31), the second airflow-direction adjusting blade (32), and the third airflow-direction adjusting blade (33) may be configured to extend in the opening direction of the blow-out port (15) without being divided in the opening direction of the blow-out port (15).

With the configuration described above, because each of the first airflow-direction adjusting blade (31), the second airflow-direction adjusting blade (32), and the third airflow-direction adjusting blade (33) is not divided in the extension direction of the blow-out port (15), it is possible to avoid leakage of the blow-out airflow from a gap that is formed if the airflow-direction adjusting blade is divided. Thus, it is possible to easily spread the blow-out airflow in the up-down direction by using the first airflow-direction adjusting blade (31), the second airflow-direction adjusting blade (32), and the third airflow-direction adjusting blade (33).

As with the modifications of the airflow adjusting mechanism of the first embodiment illustrated in FIGS. 10, 11, and 13, in the air-conditioning indoor unit (10) according to the second embodiment, when the airflow adjusting mechanism (20) includes the first airflow-direction adjusting blade (31), the second airflow-direction adjusting blade (32), and at least one the third airflow-direction adjusting blade (33), the second airflow-direction adjusting blade (32) may be configured to be continuous with a front edge portion of the blow-out port (15).

With the configuration described above, by configuring the second airflow-direction adjusting blade (32) to be continuous with the front edge portion of the blow-out port (15), it is possible to smooth the flow of air from the blow-out port (15) toward the second airflow-direction adjusting blade (32). Thus, it is possible to smooth the upward spreading of the blow-out airflow by the second airflow-direction adjusting blade (32).

In the foregoing description, examples in which the airflow adjusting mechanism (20) is constituted by airflow-direction adjusting blades (to be specific, the first airflow-direction adjusting blade (31), the second airflow-direction adjusting blade (32), and the like) have been described. However, the airflow adjusting mechanism (20) is not limited to this. For example, the airflow adjusting mechanism (20) may be constituted by a blow-out flow path (17) having an inner wall whose shape and orientation are designed so that the average airflow speed in the first range (R11) and the average airflow speed in the second range (R12) are approximately equal to each other, or may be constituted by a fixed airflow-direction adjusting blade whose orientation is designed so that the average airflow speed in the first range (R11) and the average airflow speed in the second range (R12) are approximately equal to each other.

(Modification of Wide Airflow-Speed Distribution Condition of Second Embodiment)

The air-conditioning indoor unit (10) of the second embodiment may be configured so that, under the test condition, when the airflow direction of the blow-out airflow is adjusted so that the average airflow speed in the first range (R11) and the average airflow speed in the second range (R12) are approximately equal to each other, the ratio of the average airflow speed in the third range (R13) to the average airflow speed in the first range (R11) is less than 1.1 and greater than or equal to 0.5. To be specific, in this modification, under a test condition that the air-conditioning indoor unit (10) is provided in such a way that the reference position (Q) of the blow-out port (15) is a position that is separated by 2000 mm upward from the floor, when the airflow direction of the blow-out airflow is adjusted so that the airflow direction of the blow-out airflow is a direction toward the reference height range (R10) and so that the average airflow speed in the first range (R11) and the average airflow speed in the second range (R12) are approximately equal to each other, the ratio of the average airflow speed in the third range (R13) to the average airflow speed in the first range (R11) is less than 1.1 and greater than or equal to 0.5.

The air-conditioning indoor unit (10) of the second embodiment may be configured so that, under the test condition, when the airflow direction of the blow-out airflow is adjusted so that the average airflow speed in the first range (R11) and the average airflow speed in the second range (R12) are approximately equal to each other, an airflow-speed distribution condition that the ratio of the average airflow speed in the third range (R13) to the average airflow speed in the first range (R11) is less than 1.1 and greater than or equal to 0.5 is satisfied in the range (R20), in the left-right direction, that is centered at the center position (Qc) in the left-right direction of the blow-out port (15) and that has a length in the left-right direction greater than or equal to 1000 mm. To be specific, in this example, under a test condition that the air-conditioning indoor unit (10) is provided in such a way that the reference position (Q) of the blow-out port (15) is a position that is separated by 2000 mm upward from the floor, when the airflow direction of the blow-out airflow is adjusted so that the airflow direction of the blow-out airflow is a direction toward the reference height range (R10) and so that the average airflow speed in the first range (R11) and the average airflow speed in the second range (R12) are approximately equal to each other, an airflow-speed distribution condition that the ratio of the average airflow speed in the third range (R13) to the average airflow speed in the first range (R11) is less than 1.1 and greater than or equal to 0.5 is satisfied in the range (R20) in the left-right direction. The left-right direction described above corresponds to the longitudinal direction of the rectangle that circumscribes the opening of the blow-out port (15).

[Advantageous Effects of Modification of Wide Airflow-Speed Distribution Condition]

As described above, in the modification of the wide airflow-speed distribution condition of the second embodiment, under the test condition that the air-conditioning indoor unit (10) is provided in such a way that the reference position (Q) of the blow-out port (15) is a position that is separated by 2000 mm upward from the floor, when the direction of the blow-out airflow is adjusted so that the average airflow speed in the first range (R11) and the average airflow speed in the second range (R12) are approximately equal to each other, the ratio of the average airflow speed in the third range (R13) to the average airflow speed in the first range (R11) is less than 1.1 and greater than or equal to 0.5.

With the configuration described above, because it is possible to reduce variation in the airflow speed of the blow-out airflow in a predetermined range in the up-down direction, it is possible to blow the blow-out airflow, in which variation in airflow speed in the up-down direction is reduced, toward the whole body of a user. Thus, it is possible to reduce discomfort due to hitting of the blow-out airflow on a local part of the body.

Other Embodiments

In the foregoing description, examples in which the reference point (P0), which is a point at which the wide airflow-speed distribution condition should be satisfied, is the first point (P1) have been described. However, the reference point (P0) is not limited to this. For example, the reference point (P0) may be the second point (P2) or may be any point included in a range in the front-back direction starting at the first point (P1) and ending at the second point (P2). Because a blow-out airflow tends to gradually spread in the up-down direction as air in the blow-out airflow moves further downstream, when the wide airflow-speed distribution condition is satisfied at the first point (P1), it is highly probable that the wide airflow-speed distribution condition is satisfied in the entirety of the range in the front-back direction starting at the first point (P1) and ending at the second point (P2). Conversely, there may be a case where, even when the wide airflow-speed distribution condition is satisfied at the second point (P2), the wide airflow-speed distribution condition is not satisfied in the range in the front-back direction starting at the first point (P1) and ending at the second point (P2) (excluding the second point (P2)).

In the foregoing description, examples in which the air-conditioning indoor unit (10) has the wide mode and the normal mode have been described. However, the air-conditioning indoor unit (10) is not limited to this. For example, the air-conditioning indoor unit (10) may have only the wide mode.

In the foregoing description, examples in which the air-conditioning indoor unit (10) is provided on a side wall have been described. However, the position of the air-conditioning indoor unit (10) is not limited to this. For example, the air-conditioning indoor unit (10) may be provided on a ceiling. A plurality of blow-out ports (15) may be provided in the air-conditioning indoor unit (10). That is, the number of the blow-out port (15) is not limited to one, and there may be a plurality of blow-out ports (15). The shape of the blow-out port (15) may be a rectangular shape or may be a curvilinear shape.

It should be understood that the embodiments and modifications described above can be modified in various ways in configuration and details within the sprit and scope of the claims. The embodiments and modifications described above may be combined or replaced as necessary, as long as the function of the object of the present disclosure is not impaired.

INDUSTRIAL APPLICABILITY

As heretofore described, the present disclosure relates to a blower and an air-conditioning indoor unit.

REFERENCE SIGNS LIST

10 air-conditioning indoor unit (blower)
11 casing
12 fan
13 heat exchanger
14 suction port
15 blow-out port
16 bottom frame
17 blow-out flow path
18 back-side scroll
19 front-side scroll
20 airflow adjusting mechanism
31 first airflow-direction adjusting blade
32 second airflow-direction adjusting blade
33 third airflow-direction adjusting blade
35 auxiliary adjusting blade
40 controller
P0 reference point
P1 first point
P2 second point
R10 reference height range
R11 first range
R12 second range
R13 third range
Q reference position of blow-out port
Qc center position of blow-out port in left-right direction
L15 length of blow-out port in width direction

The invention claimed is:

1. A blower provided on a side wall and having a wide mode, comprising:

a casing in which a suction port and a blow-out port are formed;

a fan provided in the casing; and an airflow adjusting mechanism configured to adjust a blow-out airflow that is a flow of air blown out from the blow-out port, by controlling a pair of blades, the pair of blades including a first airflow-direction adjusting blade provided near a back of the blow-out port and a second airflow-direction adjusting blade provided near a front of the blow-out port, wherein when in the wide mode, the blow-out airflow is divided into a first airflow along the first airflow-direction adjusting blade and a second airflow along the second airflow-direction adjusting blade, the blow-out port and the pair of blades extend in a left-right direction of the blower without a break, a length of the blow-out port in a width direction perpendicular to an extension direction of the blow-out port is less than or equal to 300 mm, a reference point is defined as at least one point that is positioned in a range, in a front-back direction, starting at a first point that is separated by 1000 mm ahead of the blower from the blow-out port and ending at a second point that is separated by 2000 mm ahead of the blower from the blow-out port, a reference height range is defined as a range, in an up-down direction, starting at the reference point and ending at a position that is separated by 1600 mm upward from the reference point, among three ranges obtained by trisecting the reference height range in the up-down direction, a first range is defined as a range positioned on an upper side, a second range is defined as a range positioned on a lower side, and a third range is defined as a range positioned at a center, and, under a test condition that the blower is provided in such a way that a reference position of the blow-out port is a position that is separated by 2000 mm upward from a floor, the airflow adjusting mechanism adjusts, in the wide mode, the blow-out airflow so that an average airflow speed in the first range and an average airflow speed in the second range are approximately equal to each other and so that a ratio of an average airflow speed in the third range to the average airflow speed in the first range is less than 1.5.

2. The blower according to claim 1, wherein the airflow adjusting mechanism adjusts, in the wide mode under the test condition, the blow-out airflow so that the average airflow speed in the first range and the average airflow speed in the second range are approximately equal to each other and so that the ratio of the average airflow speed in the third range to the average airflow speed in the first range is less than 1.1 and greater than or equal to 0.5.

3. The blower according to claim 1, wherein the airflow adjusting mechanism adjusts, in the wide mode under the test condition, the blow-out airflow so that an average airflow speed in the reference height range is greater than or equal to 0.5 m/s.

4. The blower according to claim 1, wherein the length of the blow-out port in the width direction is less than or equal to 150 mm.

5. The blower according to claim 1, wherein the airflow adjusting mechanism adjusts, in the wide mode under the test condition, the blow-out airflow so that an airflow-speed distribution condition that the average airflow speed in the first range and the average airflow speed in the second range are approximately equal to each other and that the ratio of the average airflow speed in the third range to the average airflow speed in the first range is less than 1.5 is satisfied in a range, in the left-right direction, that is centered at a center position of the blow-out port in the left-right direction and that has a length in the left-right direction greater than or equal to 1000 mm.

6. The blower according to claim 1, wherein the first airflow-direction adjusting blade is configured to spread the blow-out airflow downward in the wide mode, and the second airflow-direction adjusting blade is configured to spread the blow-out airflow upward in the wide mode.

7. The blower according to claim 6, wherein the first airflow-direction adjusting blade and the second airflow-direction adjusting blade are configured to divide the blow-out airflow in the up-down direction in the wide mode due to a Coanda effect.

8. The blower according to claim 6, wherein the airflow adjusting mechanism includes at least one third airflow-direction adjusting blade provided between the first airflow-direction adjusting blade and the second airflow-direction adjusting blade, and the third airflow-direction adjusting blade is configured to divide the blow-out airflow in the up-down direction in the wide mode.

9. The blower according to claim 8, wherein the second airflow-direction adjusting blade is configured to be continuous with a front edge portion of the blow-out port.

10. The blower according to claim 8, wherein each of the first airflow-direction adjusting blade, the second airflow-direction adjusting blade, and the third airflow-direction adjusting blade extends in the extension direction of the blow-out port without being divided in the extension direction of the blow-out port.

11. The blower according to claim 1, wherein the airflow adjusting mechanism includes three or more auxiliary adjusting blades provided at the blow-out port to be arranged in the left-right direction, and each of the three or more auxiliary adjusting blades is configured to divide the blow-out airflow in the left-right direction.

12. An air-conditioning indoor unit comprising:

the blower according to claim 1; and a heat exchanger accommodated in the casing, wherein the heat exchanger is configured to cause air sucked from the suction port and a refrigerant to exchange heat, and air that has passed through the heat exchanger is blown out from the blow-out port.

13. A blower comprising:

a casing in which a suction port and a blow-out port are formed;

a fan provided in the casing; and an airflow adjusting mechanism configured to adjust a blow-out airflow that is a flow of air blown out from the blow-out port by controlling a pair of blades, the pair of blades including a first airflow-direction adjusting blade provided near a back of the blow-out port and a second airflow-direction adjusting blade provided near a front of the blow-out port, wherein when in a wide mode, the blow-out airflow is divided into a first airflow along the first airflow-direction adjusting blade and a second airflow along the second airflow-direction adjusting blade, the blow-out port and the pair of blades extend in a left-right direction of the blower without a break, a shape of an opening of the blow-out port is such that a length of a short side of a rectangle that circumscribes the opening is less than or equal to 300 mm, under a test condition that the blower is provided in such a way that a reference position of the blow-out port is a position that is separated by 2000 mm upward from a floor, a reference point is defined as at least one point that is positioned in a range, in a front-back direction, starting at a first point that is separated by 1000 mm ahead of the blower from a point on the floor directly below the reference position of the blow-out port and ending at a second point that is separated by 2000 mm ahead of the blower from the point on the floor directly below the reference position of the blow-out port, a reference height range is defined as a range, in an up-down direction, starting at the reference point and ending at a position that is separated by 1600 mm upward from the reference point, among three ranges obtained by trisecting the reference height range in the up-down direction, a first range is defined as a range positioned on an upper side, a second range is defined as a range positioned on a lower side, and a third range is defined as a range positioned at a center, and, under the test condition, when an airflow direction of the blow-out airflow is adjusted so that an average airflow speed in the first range and an average airflow speed in the second range are approximately equal to each other, a ratio of an average airflow speed in the third range to the average airflow speed in the first range is less than 1.5.

14. The blower according to claim 13, wherein under the test condition, when the airflow direction of the blow-out airflow is adjusted so that the average airflow speed in the first range and the average airflow speed in the second range are approximately equal to each other, the ratio of the average airflow speed in the third range to the average airflow speed in the first range is less than 1.1 and greater than or equal to 0.5.

15. The blower according to claim 13, wherein under the test condition, when the airflow direction of the blow-out airflow is adjusted so that the average airflow speed in the first range and the average airflow speed in the second range are approximately equal to each other, an average airflow speed in the reference height range is greater than or equal to 0.5 m/s.

16. The blower according to claim 13, wherein the length of the short side of the rectangle of the blow-out port is less than or equal to 150 mm.

17. The blower according to claim 13, wherein under the test condition, when the airflow direction of the blow-out airflow is adjusted so that the average airflow speed in the first range and the average airflow speed in the second range are approximately equal to each other, an airflow-speed distribution condition that the ratio of the average airflow speed in the third range to the average airflow speed in the first range is less than 1.5 is satisfied in a range, in a longitudinal direction of the rectangle, that is centered at a center position of the blow-out port in the longitudinal direction of the rectangle and that has a length in the longitudinal direction of the rectangle greater than or equal to 1000 mm.

18. The blower according to claim 13, wherein the first airflow-direction adjusting blade is configured to spread the blow-out airflow downward, and the second airflow-direction adjusting blade is configured to spread the blow-out airflow upward.

19. The blower according to claim 18, wherein the first airflow-direction adjusting blade and the second airflow-direction adjusting blade are configured to divide the blow-out airflow in the up-down direction due to a Coanda effect.

20. The blower according to claim 18, wherein the airflow adjusting mechanism includes at least one third airflow-direction adjusting blade provided between the first airflow-direction adjusting blade and the second airflow-direction adjusting blade, and the third airflow-direction adjusting blade is configured to divide the blow-out airflow in the up-down direction.

21. The blower according to claim 20, wherein the second airflow-direction adjusting blade is configured to be continuous with a front edge portion of the blow-out port.

22. The blower according to claim 20, wherein each of the first airflow-direction adjusting blade, the second airflow-direction adjusting blade, and the third airflow-direction adjusting blade extends in an opening direction of the blow-out port without being divided in the opening direction of the blow-out port.

23. The blower according to claim 13, wherein the airflow adjusting mechanism includes three or more auxiliary adjusting blades provided at the blow-out port to be arranged in a longitudinal direction of the rectangle of the blow-out port, and each of the three or more auxiliary adjusting blades is configured to divide the blow-out airflow in the longitudinal direction of the rectangle of the blow-out port.

24. An air-conditioning indoor unit comprising:

the blower according to claim 13; and a heat exchanger accommodated in the casing, wherein the heat exchanger is configured to cause air sucked from the suction port and a refrigerant to exchange heat, and air that has passed through the heat exchanger is blown out from the blow-out port.

* * * * *